US010889782B2

(12) United States Patent
Bauer et al.

(10) Patent No.: US 10,889,782 B2
(45) **Date of Patent: *Jan. 12, 2021**

(54) COMPOSITION SUITABLE AS DEGREASING AGENT FOR REMOVING GREASY AND/OR OIL TYPE DEPOSITS

(71) Applicant: BASF SE, Ludwigshafen am Rhein (DE)

(72) Inventors: Frederic Bauer, Ludwigshafen am Rhein (DE); Rainer Eskuchen, Düsseldorf-Holthausen (DE); Claudia Esper, Ludwigshafen am Rhein (DE)

(73) Assignee: BASF SE

( * ) Notice: Subject to any disclaimer, the term of this patent is extended or adjusted under 35 U.S.C. 154(b) by 29 days.

This patent is subject to a terminal disclaimer.

(21) Appl. No.: 16/310,186

(22) PCT Filed: Jul. 5, 2017

(86) PCT No.: PCT/EP2017/066848

§ 371 (c)(1),
(2) Date: Dec. 14, 2018

(87) PCT Pub. No.: WO2018/007478

PCT Pub. Date: Jan. 11, 2018

(65) Prior Publication Data

US 2019/0185784 A1 Jun. 20, 2019

(30) Foreign Application Priority Data

Jul. 5, 2016 (EP) ..... 16178042

(51) Int. Cl.

| | |
|---|---|
| ***C11D 1/825*** | (2006.01) |
| ***C11D 3/22*** | (2006.01) |
| ***C11D 1/66*** | (2006.01) |

(52) U.S. Cl.
CPC ..... *C11D 1/662* (2013.01); *C11D 1/825* (2013.01)

(58) Field of Classification Search
CPC ..... C11D 1/662; C11D 1/825; C11D 3/22
See application file for complete search history.

(56) References Cited

U.S. PATENT DOCUMENTS

H171 H * 12/1986 McDaniel ..... 510/470
5,688,930 A 11/1997 Bertho et al.
(Continued)

FOREIGN PATENT DOCUMENTS

DE 69504158 T2 3/1999
DE 19819187 A1 11/1999
(Continued)

OTHER PUBLICATIONS

International Preliminary Examination Report for PCT/EP2017/066848 dated Jun. 8, 2018.
(Continued)

*Primary Examiner* — Brian P Mruk
(74) *Attorney, Agent, or Firm* — Faegre Drinker Biddle & Reath LLP

(57) ABSTRACT

The present invention refers to a composition comprising two or more compounds of the general formula (I), a dry or liquid formulation comprising said composition as well as the use of said composition as degreasing agent for removing greasy and/or oil type deposits or as emulsifying agent or as wetting agent.

(I)

20 Claims, 2 Drawing Sheets

(56) References Cited

U.S. PATENT DOCUMENTS

| | | | | |
|---|---|---|---|---|
| 6,156,543 | A | 12/2000 | Bertho et al. | |
| 6,462,006 | B1 | 10/2002 | Sorg et al. | |
| 6,774,113 | B2 | 8/2004 | Bertho et al. | |
| 6,963,014 | B1 | 11/2005 | Zeller et al. | |
| 9,738,858 | B2 * | 8/2017 | Bauer | C11D 3/2017 |
| 9,777,246 | B2 * | 10/2017 | Bauer | C07H 15/04 |
| 9,845,446 | B2 * | 12/2017 | Bauer | C11D 1/825 |
| 10,184,094 | B2 * | 1/2019 | Bauer | C07H 15/04 |
| 2015/0368588 | A1 * | 12/2015 | Bauer | C07H 1/00 510/365 |

FOREIGN PATENT DOCUMENTS

| | | | |
|---|---|---|---|
| DE | 19944543 | A1 | 3/2001 |
| DE | 69712602 | T2 | 1/2003 |
| EP | 0851023 | A2 | 7/1998 |
| EP | 1230200 | A2 | 8/2002 |
| FR | 2967164 | A1 | 5/2012 |
| WO | WO-9823566 | A1 | 6/1998 |
| WO | WO-0136356 | A2 | 5/2001 |
| WO | WO-2015000792 | A1 | 1/2015 |
| WO | WO-2015091160 | A1 | 6/2015 |

OTHER PUBLICATIONS

International Search Report for PCT/EP2017/066425 dated Jul. 28, 2017.

International Search Report for PCT/EP2017/066848 dated Aug. 2, 2017.

Written Opinion of the International Searching Authority for PCT/EP2017/066425 dated Jul. 28, 2017.

Written Opinion of the International Searching Authority for PCT/EP2017/066848 dated Aug. 2, 2017.

U.S. Appl. No. 16/310,256, filed Dec. 14, 2018, Bauer et al.

* cited by examiner

COMPOSITION SUITABLE AS DEGREASING AGENT FOR REMOVING GREASY AND/OR OIL TYPE DEPOSITS

CROSS-REFERENCE TO RELATED APPLICATIONS

This application is a national stage application (under 35 U.S.C. § 371) of PCT/EP2017/066848, filed Jul. 5, 2017, which claims benefit of European Application No. 16178042.4, filed Jul. 5, 2016, both of which are incorporated herein by reference in their entirety.

FIELD OF THE INVENTION

The present invention refers to a composition of two or more compounds of the general formula (I), a dry or liquid formulation comprising said composition as well as the use of said composition as degreasing agent for removing greasy and/or oil type deposits or as emulsifying agent or as wetting agent.

BACKGROUND OF THE INVENTION

Detergent compositions are well known in the art and can be formulated in a number of different ways to address a number of different cleaning problems. For example, such compositions may comprise a great variety of compounds such as builders, optical brighteners, dispersants, enzymes, perfumes, surfactants (anionic, nonionic, cationic and/or amphotheric), soaps, silicon based defoamers, bleaching agents, colorants, dye transfer inhibitors, complexing agents etc., in order to address various problems encountered in cleaning processes. Furthermore, such compositions are typically formulated such that they are effective against the broadest possible spectrum of stains. This need is addressed by providing compositions comprising one or more agent(s) which is/are broadly effective in their cleaning performance.

One particular problem which must be considered and addressed when formulating cleaning compositions is the removal of greasy and oil type deposits such as sebum, oil- and/or fat-containing compositions etc. This problem is even more challenging as the trend in present consumers' behavior goes towards low temperature cleaning operations. That is to say, a sufficient degreasing performance must be achievable at temperatures below 40° C. On the other hand, in industrial washing applications wetting agents are typically used in order to improve the cleaning efficiency at temperatures of far above 40° C. Accordingly, the performance of the compositions and the active compounds contained therein must be achieved over a wide temperature range.

However, compounds or compositions which are known as being sufficient as regards their degreasing behavior at high temperatures typically show a limited degreasing performance at low temperatures and are thus considered unsuitable for such applications. Furthermore, the wetting behavior of such compounds or compositions at high temperatures is still not sufficient. Therefore, there is a need in the art for providing a compound which avoids the foregoing disadvantages and especially allows for the removal of greasy and/or oil type deposits, especially when used at temperatures of ≥40° C. Furthermore, it is desirable to provide a compound which shows an improved wetting behavior, especially at temperatures of ≥40° C. Furthermore, it is desirable to provide a compound which allows for the use as emulsifying agent.

Accordingly, it is an object of the present invention to provide a compound or composition that can be used as degreasing agent for the removal of greasy and/or oil type deposits, especially at temperatures of ≥40° C. Furthermore, it is an object of the present invention to provide a compound or composition that can be used as wetting agent, especially at temperatures of ≥40° C. It is another object of the present invention to provide a compound or composition that can be used as emulsifying agent. It is an even further object of the present invention to provide a compound or composition that can be used in cleaning formulations.

SUMMARY OF THE INVENTION

The foregoing and other objects are solved by the subject-matter of the present invention.

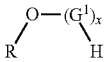

(I)

According to a first aspect of the present invention, a composition comprising two or more compounds of the general formula (I), wherein R is unsubstituted branched $C_9$-$C_{15}$-alkyl, $G^1$ is selected from monosaccharides with 5 or 6 carbon atoms; x is in the range of from 1 to 10 and refers to average values, and wherein the two or more compounds differ in R and/or $G^1$ and/or x, is provided.

The inventors surprisingly found out that the composition comprising two or more compounds of the general formula (I), as defined herein, can be used as degreasing agent for the removal of greasy and/or oil type deposits, especially at temperatures of ≥40° C., but also as wetting agent, especially at temperatures of ≥40° C. Furthermore, the composition comprising two or more compounds of the general formula (I), as defined herein, can be used as emulsifying agent. Furthermore, the composition comprising two or more compounds of the general formula (I), as defined herein, can be used in cleaning formulations.

According to a further aspect of the present invention, a dry or liquid formulation comprising the composition comprising two or more compounds of the general formula (I), as defined herein, is provided. In one embodiment, the formulation further comprises additives selected from the group comprising anionic surfactants, nonionic surfactants, cationic surfactants, amphoteric surfactants, enzymes, bleaching agents, peroxygen compounds, optical brightener, complexing agents, polymers, e.g. polycarboxylates, soaps, silicon based defoamers, bleaching agents, colorants, dye transfer inhibitors and mixtures thereof. In another embodiment, the formulation is a single dose formulation or a high concentrated powder formulation having a bulk density of above 600 g/l.

According to still another aspect of the present invention, the use of the composition comprising two or more compounds of the general formula (I), as defined herein, as degreasing agent for removing greasy and/or oil type deposits is provided. Preferably, the composition comprising two or more compounds of the general formula (I), as defined herein, is used as degreasing agent for removing greasy type deposits. In one embodiment, the composition comprising two or more compounds of the general formula (I), as defined herein, is used as degreasing agent for removing greasy and/or oil type deposits, preferably greasy type deposits, at temperatures of ≥40° C., preferably in the range from 5 to 40° C.

According to an even further aspect of the present invention, the use of the composition comprising two or more compounds of the general formula (I), as defined herein, as emulsifying agent is provided.

According to a still further aspect of the present invention, the use of the composition comprising two or more compounds of the general formula (I), as defined herein, as wetting agent is provided. In one embodiment, in the general formula (I) R is unsubstituted branched $C_{13}$-alkyl and $G^1$ is glucose and x is in the range from 1.05 to 2.5, preferably in the range from 1.10 to 1.8. In another embodiment, the composition comprising two or more compounds of the general formula (I), as defined herein, is used as wetting agent at temperatures of ≥40° C., preferably in the range from 40 to 120° C.

Advantageous embodiments of the inventive compound of the general formula (I) are defined in the corresponding sub-claims.

According to one embodiment, in the general formula (I) R is unsubstituted branched $C_9$-$C_{13}$-alkyl, preferably unsubstituted branched $C_9$- or $C_{10}$- or $C_{13}$-alkyl, and most preferably unsubstituted branched $C_{10}$- or $C_{13}$-alkyl.

According to another embodiment, in the general formula (I) $G^1$ is selected from the group consisting of glucose, xylose, arabinose, rhamnose and mixtures thereof, and/or x is in the range of from 1.05 to 2.5 and preferably in the range of from 1.10 to 1.8.

According to yet another embodiment, in the general formula (I) R is unsubstituted branched $C_{10}$- or $C_{13}$-alkyl, preferably unsubstituted branched $C_{13}$-alkyl, and $G^1$ is glucose and/or xylose and x is in the range of from 1.05 to 2.5.

According to one embodiment, in the general formula (I) R is unsubstituted branched $C_{13}$-alkyl and $G^1$ is xylose and x is in the range of from 1.10 to 1.8.

According to another embodiment, in the general formula (I) R has an average number of branching in the range from 0.9 to 3.5, more preferably from 1.8 to 3.5 and most preferably from 2.0 to 2.5.

According to yet another embodiment, the two or more compounds of the general formula (I) differ in R.

In the following, the details and preferred embodiments of the inventive composition comprising two or more compounds of the general formula (I) will be described in more detail. It is to be understood that these technical details and embodiments also apply to the inventive dry or liquid formulation and uses.

DETAILED DESCRIPTION OF THE INVENTION

A composition comprising two or more compounds of the general formula (I),

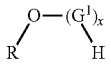

(I)

wherein R is unsubstituted branched $C_9$-$C_{15}$-alkyl, $G^1$ is selected from monosaccharides with 5 or 6 carbon atoms; x is in the range of from 1 to 10 and refers to average values and wherein the two or more compounds differ in R and/or $G^1$ and/or x is provided.

It was surprisingly found out by the inventors that said composition comprising two or more compounds of the general formula (I) shows a degreasing performance for greasy and/or oil type deposits, especially at temperatures of ≥40° C., and thus can be used as degreasing agent. Furthermore, it was found out that said composition comprising two or more compounds of the general formula (I) shows excellent emulsifying properties and thus can be used as emulsifying agent. Furthermore, it was found out that said composition comprising two or more compounds of the general formula (I) shows excellent wetting performance, especially at temperatures of ≥40° C., and thus can be used as wetting agent. Accordingly, said composition comprising two or more compounds of the general formula (I) shows excellent performances and thus can be used in cleaning formulations.

In the general formula (I), R is unsubstituted branched $C_9$-$C_{15}$-alkyl, preferably unsubstituted branched $C_9$-$C_{13}$-alkyl, more preferably unsubstituted branched $C_9$- or $C_{10}$- or $C_{13}$-alkyl, and most preferably unsubstituted branched $C_{10}$- or $C_{13}$-alkyl. For example, R is unsubstituted branched $C_{13}$-alkyl.

It is appreciated that R is preferably obtained by a hydroformulation process as described in WO 01/36356 A2, which is thus incorporated herewith by reference.

As used herein, the term "branched alkyl" is a radical of a saturated branched aliphatic group having an average number of branching of at least 0.7 as defined below. Preferably, the term "branched alkyl" refers to a radical of a saturated branched aliphatic group having an average number of branching of ranging from 0.9 to 3.5, more preferably ranging from 1.8 to 3.5 and most preferably from 2.0 to 2.5 as defined below. It is appreciated that the number of carbon atoms includes carbon atoms along the chain backbone as well as branching carbons.

As used herein, the phrase average number of branches per molecule chain refers to the average number of branches per alcohol molecule which corresponds to the corresponding branched alkyl, as measured by $^{13}C$ Nuclear Magnetic Resonance ($^{13}C$ NMR). The average number of carbon atoms in the chain are determined by gas chromatography.

Various references will be made throughout this specification and the claims to the percentage of branching at a given carbon position, the percentage of branching based on types of branches, average number of branches, and percentage of quaternary atoms. These amounts are to be measured and determined by using a combination of the following three $^{13}C$-NMR techniques.

(1) The first is the standard inverse gated technique using a 45-degree tip $^{13}C$ pulse and 10 s recycle delay (an organic free radical relaxation agent is added to the solution of the branched alcohol in deuterated chloroform to ensure quantitative results). (2) The second is a J-Modulated Spin Echo NMR technique (JMSE) using a 1/J delay of 8 ms (J is the 125 Hz coupling constant between carbon and proton for these aliphatic alcohols). This sequence distinguishes carbons with an odd number of protons from those bearing an even number of protons, i.e. $CH_3$/CH vs $CH_2$/Cq (Cq refers to a quaternary carbon) (3) The third is the JMSE NMR "quat-only" technique using a ½J delay of 4 ms which yields a spectrum that contains signals from quaternary carbons only. The JSME NMR quat only technique for detecting quaternary carbon atoms is sensitive enough to detect the presence of as little at 0.3 atom % of quaternary carbon atoms. As an optional further step, if one desires to confirm a conclusion reached from the results of a quat only JSME NMR spectrum, one may also run a DEPT-135 NMR sequence. The DEPT-135 NMR sequence may be very helpful in differentiating true quaternary carbons from breakthrough protonated carbons. This is due to the fact that the DEPT-135 sequence produces the "opposite" spectrum to that of the JMSE "quat-only" experiment. Whereas the latter nulls all signals except for quaternary carbons, the DEPT-135 nulls exclusively quaternary carbons. The combination of the two spectra is therefore very useful in spotting non quaternary carbons in the JMSE "quatonly" spectrum. When referring to the presence or absence of quaternary carbon atoms throughout this specification, however, it is meant that the given amount or absence of the quaternary carbon is as measured by the quat only JSME NMR method. If one optionally desires to confirm the results, then also using the DEPT-135 technique to confirm the presence and amount of a quaternary carbon.

For example, the branched $C_{13}$-alkyl has an average number of branching of from 0.9 to 3.5, more preferably ranging from 1.8 to 3.5 and most preferably from 2.0 to 2.5. The number of branching is defined as the number of methyl groups in one molecule of the corresponding alcohol of the branched alkyl minus 1. The average number of branching is the statistical average of the number of branching of the molecules of a sample.

The branched alkyl can be characterized by the NMR technique as having from 5 to 25% branching on the $C_2$ carbon position, relative to the ether group. In a preferred embodiment, from 10 to 20% of the number of branches are at the $C_2$ position, as determined by the NMR technique. The branched alkyl also generally has from 10% to 50% of the number of branches on the $C_3$ position, more typically from 15% to 30% on the $C_3$ position, also as determined by the NMR technique. When coupled with the number of branches seen at the $C_2$ position, the branched alkyl in this case contain significant amount of branching at the $C_2$ and $C_3$ carbon positions.

Thus, the branched alkyl of the present invention has a significant number of branches at the $C_2$ and $C_3$ positions. Additionally or alternatively, the branched alkyl preferably has ≥7%, more preferably ≤5%, of isopropyl terminal type of branching, as determined by the NMR technique, meaning methyl branches at the second to last carbon position in the backbone relative to the ether group.

In one embodiment, the branching occurs across the length of the carbon backbone. It is however preferred that at least 20%, more preferably at least 30%, of the branches are concentrated at the $C_2$, $C_3$, and isopropyl positions. Alternatively, the total number of methyl branches number is at least 40%, even at least 50%, of the total number of branches, as measured by the NMR technique described above. This percentage includes the overall number of methyl branches seen by the NMR technique described above within the $C_1$ to the $C_3$ carbon positions relative to the ether group, and the terminal isopropyl type of methyl branches.

The branched alkyl, its characterization and synthesis are further described in WO, 01/36356 A2, WO98/23566 A1 and EP1230200 A1 which are thus herewith incorporated by reference.

The term "unsubstituted" means that the branched alkyl group is free of substituents, i.e. the branched alkyl group is composed of carbon and hydrogen atoms only.

In one embodiment, the two or more compounds of the composition differ in R. Preferably, the composition comprises a mixture of two or more compounds of the general formula (I) differing in R, while $G^1$ and x are the same. If the two or more compounds of the composition differ in R, R may differ in the number of carbon atoms (i.e. the length) or the kind of branching.

For example, if the two or more compounds of the composition differ in the number of carbon atoms (i.e. the length), one of the two or more compounds is a compound, wherein R is unsubstituted branched $C_9$-alkyl, and one or more compound(s) of the two or more compounds is a compound, wherein R is unsubstituted branched $C_{10}$-alkyl, unsubstituted branched $C_{11}$-alkyl, unsubstituted branched $C_{12}$-alkyl, unsubstituted branched $C_{13}$-alkyl, unsubstituted branched $C_{14}$-alkyl and/or unsubstituted branched $C_{15}$-alkyl.

Alternatively, if the two or more compounds of the composition differ in the kind of branching, it is appreciated that the two or more compounds are compounds having the same number of carbon atoms (i.e. the length), but the branching across the length of the carbon backbone is different. For example, each of the two or more compounds are unsubstituted branched $C_{13}$-alkyl, wherein R differs in the branching across the length of the carbon backbone. Accordingly, R is a mixture of different unsubstituted branched $C_9$-$C_{15}$-alkyl.

If R is a mixture of different unsubstituted branched $C_9$-$C_{15}$-alkyl, it is appreciated that it is not excluded that the inventive composition comprises minor amounts of R being unsubstituted straight-chain $C_9$-$C_{15}$-alkyl, i.e. $C_9$-$C_{15}$-alkyl being free of branches. For example, the composition comprising two or more compounds of the general formula (I), comprises one or more compounds, wherein R is unsubstituted straight-chain $C_9$-$C_{15}$-alkyl, in an amount of ≥1.0 wt.-%, based on the total weight of the composition.

Preferably, the two or more compounds of the composition differ in R.

The two or more compounds of the general formula (I) are preferably obtained by the corresponding glycosylation of a mixture of alcohols. It is to be noted that the mixture of alcohols is preferably obtained by hydroformylating and optionally hydrogenation of a trimer butene or a tetramer propene, more preferably of a trimer butene. A process for preparing the mixture of alcohols is e.g. described in WO, 01/36356 A2 which is thus herewith incorporated by reference.

In the general formula (I), $G^1$ is selected from monosaccharides with 5 or 6 carbon atoms. For example, $G^1$ is selected from pentoses, and hexoses. Examples of pentoses are ribulose, xylulose, ribose, arabinose, xylose and lyxose. Examples of hexoses are galactose, mannose, rhmanose and glucose. Monosaccharides may be synthetic or derived or isolated from natural products, hereinafter in brief referred to as natural saccharides or natural polysaccharides, and natural saccharides natural polysaccharides being preferred. More preferred are the following natural monosaccharides: glucose, xylose, arabinose, rhamnose and mixtures of the foregoing, even more preferred are glucose and/or xylose, and in particular xylose. Monosaccharides can be selected from any of their enantiomers, naturally occurring enantiomers and naturally occurring mixtures of enantiomers being preferred. Naturally, in a specific molecule only whole groups of $G^1$ can occur.

Thus, if $G^1$ in the general formula (I) is a pentose, the pentose may be selected from ribulose such as D-ribulose, L-ribulose and mixtures thereof, preferably D-ribulose, xylulose such as D-xylulose, L-xylulose and mixtures thereof, preferably D-xylulose, ribose such as D-ribose, L-ribose and mixtures thereof, preferably D-ribose, arabinose such as D-arabinose, L-arabinose and mixtures thereof, preferably L-arabinose, xylose such as D-xylose, L-xylose and mixtures thereof, preferably D-xylose and lyxose such as D-lyxose, L-lyxose and mixtures thereof, preferably D-lyxose. If $G^1$ in the general formula (I) is a hexose, the hexose may be selected from galactose such as D-galactose, L-galactose and mixtures thereof, preferably D-galactose, mannose such as D-mannose, L-mannose and mixtures thereof, preferably D-mannose, rhamnose such as D-rhamnose, L-rhamnose and mixtures thereof, preferably L-rhamnose and glucose such as D-glucose, L-glucose and mixtures thereof, preferably D-glucose. More preferably, $G^1$ in the general formula (I) is glucose, preferably D-glucose, xylose, preferably D-xylose, arabinose, preferably D-arabinose, rhamnose, preferably L-rhamnose, and mixtures of the foregoing, even more preferably $G^1$ in the general formula (I) is glucose, preferably D-glucose and/or xylose, preferably D-xylose, and/or arabinose, preferably D-arabinose, and in particular xylose, preferably D-xylose and/or arabinose, preferably D-arabinose. For example, $G^1$ in the general formula (I) is xylose, preferably D-xylose or arabinose, preferably D-arabinose.

In one embodiment of the present invention, $G^1$ is selected from monosaccharides with 5 carbon atoms, preferably from xylose, preferably D-xylose. This embodiment is especially advantageous if the compound of the general formula (I) is used as degreasing agent or emulsifying agent.

In an alternative embodiment, $G^1$ is selected from monosaccharides with 6 carbon atoms, preferably from glucose, preferably D-glucose. This embodiment is especially advantageous if the compound of the general formula (I) is used as wetting agent.

In one embodiment, $G^1$ is selected from monosaccharides with 5 or 6 carbon atoms, which are obtained from a fermentative process of a biomass source. The biomass source may be selected from the group comprising pine wood, beech wood, wheat straw, corn straw, switchgrass, flax, barley husk, oat husk, bagasse, miscanthus and the like.

Thus, it is appreciated that $G^1$ can comprise a mixture of monosaccharides with 5 or 6 carbon atoms.

Preferred mixtures of monosaccharides with 5 or 6 carbon atoms include, but are not limited to, a mixture of xylose and glucose or a mixture of xylose and arabinose and optionally glucose. Thus, $G^1$ is preferably a mixture of xylose and glucose or a mixture of xylose and arabinose and optionally glucose.

If the mixture of monosaccharides with 5 or 6 carbon atoms comprises a mixture of glucose and xylose, the weight ratio of glucose to xylose may vary in a wide range, depending on the biomass source used. For example, if the mixture of monosaccharides with 5 or 6 carbon atoms comprises a mixture of glucose and xylose, the weight ratio of glucose to xylose (glucose [wt.-%]/xylose [wt.-%]) in the mixture is preferably from 20:1 to 1:10, more preferably from 10:1 to 1:5, even more preferably from 5:1 to 1:2 and most preferably from 3:1 to 1:1.

If the mixture of monosaccharides with 5 or 6 carbon atoms comprises a mixture of xylose and arabinose, the weight ratio of xylose to arabinose may vary in a wide range, depending on the biomass source used. For example, if the mixture of monosaccharides with 5 or 6 carbon atoms comprises a mixture of xylose and arabinose, the weight ratio of xylose to arabinose (xylose [wt.-%]/arabinose [wt.-%]) in the mixture is preferably from 150:1 to 1:10, more preferably from 100:1 to 1:5, even more preferably from 90:1 to 1:2 and most preferably from 80:1 to 1:1.

If the mixture of monosaccharides with 5 or 6 carbon atoms comprises a mixture of glucose and xylose and arabinose, the weight ratio of glucose to xylose to arabinose may vary in a wide range, depending on the biomass source used. For example, if the mixture of monosaccharides with 5 or 6 carbon atoms comprises a mixture of glucose and xylose and arabinose, the weight ratio of glucose to arabinose (glucose [wt.-%]/arabinose [wt.-%]) in the mixture is preferably from 220:1 to 1:20, more preferably from 200:1 to 1:15, even more preferably from 190:1 to 1:10 and most preferably from 180:1 to 1:8. Additionally or alternatively, the weight ratio of xylose to arabinose (xylose [wt.-%]/arabinose [wt.-%]) in the mixture is preferably from 150:1 to 1:20, more preferably from 120:1 to 1:15, even more preferably from 100:1 to 1:10 and most preferably from 80:1 to 1:8. Additionally or alternatively, the weight ratio of glucose to xylose (glucose [wt.-%]/xylose [wt.-%]) in the mixture is preferably from 150:1 to 1:20, more preferably from 120:1 to 1:15, even more preferably from 100:1 to 1:10 and most preferably from 80:1 to 1:8.

Further mixtures of monosaccharides with 5 or 6 carbon atoms are disclosed in DE69504158T2, DE69712602T2, FR2967164, and U.S. Pat. No. 6,774,113, which contents are thus herewith incorporated by references.

In one embodiment, especially if $G^1$ is obtained from a fermentative process of a biomass source, $G^1$ may comprise minor amounts of monosaccharides differing from the monosaccharides with 5 or 6 carbon atoms.

Preferably, $G^1$ comprises ≥10 wt.-%, more preferably ≤5 wt.-%, based on the total weight of the monosaccharide, of monosaccharides differing from the monosaccharides with 5 or 6 carbon atoms. That is to say, $G^1$ comprises ≥90 wt.-%, more preferably ≥95 wt.-%, based on the total weight of the monosaccharide, of the monosaccharides with 5 or 6 carbon atoms.

In the general formula (I), x (also named degree of polymerization (DP)) is in the range of from 1 to 10, preferably x is in the range of from 1.05 to 2.5 and most preferably x is in the range of from 1.10 to 1.8, e.g. from 1.1 to 1.4. In the context of the present invention, x refers to average values, and x is not necessarily a whole number. In a specific molecule only whole groups of $G^1$ can occur. It is preferred to determine x by high temperature gas chromatography (HTGC), e.g. 400° C., in accordance with K. Hill et al., Alkyl Polyglycosides, VCH Weinheim, New York, Basel, Cambridge, Tokyo, 1997, in particular pages 28 ff., or by HPLC. In HPLC methods, x may be determined by the Flory method. If the values obtained by HPLC and HTGC are different, preference is given to the values based on HTGC.

Thus, it is preferred that in the composition comprising two or more compounds of the general formula (I),

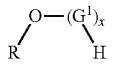

(I)

R is unsubstituted branched $C_9$-$C_{13}$-alkyl; $G^1$ is selected from the group consisting of glucose, xylose, arabinose, rhamnose and mixtures thereof; and x is in the range of from 1.05 to 2.5 and refers to average values.

For example, in the composition comprising two or more compounds of the general formula (I),

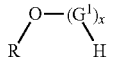

(I)

R is unsubstituted branched $C_9$-$C_{13}$-alkyl; $G^1$ is selected from the group consisting of glucose, xylose, arabinose, rhamnose and mixtures thereof; and x is in the range of from 1.10 to 1.8 and refers to average values.

Preferably, in the composition comprising two or more compounds of the general formula (I),

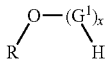

(I)

R is unsubstituted branched $C_9$- or $C_{10}$- or $C_{13}$-alkyl; $G^1$ is selected from the group consisting of glucose, xylose, arabinose, rhamnose and mixtures thereof and x is in the range of from 1.05 to 2.5 and refers to average values.

For example, in the composition comprising two or more compounds of the general formula (I),

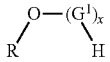

(I)

R is unsubstituted branched $C_9$- or $C_{10}$- or $C_{13}$-alkyl; $G^1$ is selected from the group consisting of glucose, xylose, arabinose, rhamnose and mixtures thereof and x is in the range of from 1.10 to 1.8 and refers to average values.

More preferably, in the composition comprising two or more compounds of the general formula (I),

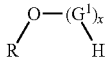

(I)

R is unsubstituted branched $C_{10}$- or $C_{13}$-alkyl; $G^1$ is selected from the group consisting of glucose, xylose, arabinose, rhamnose and mixtures thereof and x is in the range of from 1.05 to 2.5 and refers to average values.

For example, in the composition comprising two or more compounds of the general formula (I),

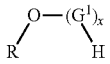

(I)

R is unsubstituted branched $C_{10}$- or $C_{13}$-alkyl; $G^1$ is selected from the group consisting of glucose, xylose, arabinose, rhamnose and mixtures thereof and x is in the range of from 1.10 to 1.8 and refers to average values.

Most preferably, in the composition comprising two or more compounds of the general formula (I),

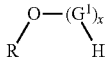

(I)

R is unsubstituted branched $C_{10}$- or $C_{13}$-alkyl; $G^1$ is selected from the group consisting of glucose and/or xylose, and x is in the range of from 1.05 to 2.5 and refers to average values.

For example, in the composition comprising two or more compounds of the general formula (I),

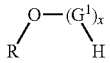

(I)

R is unsubstituted branched $C_{10}$- or $C_{13}$-alkyl; $G^1$ is selected from the group consisting of glucose and/or xylose, and x is in the range of from 1.10 to 1.8 and refers to average values.

In one embodiment, R differs in the branching across the length of the carbon backbone. Accordingly, R is a mixture of different unsubstituted branched $C_{10}$- or $C_{13}$-alkyl.

Especially preferred is the composition comprising two or more compounds of the general formula (I),

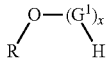

(I)

wherein R is unsubstituted branched $C_{13}$-alkyl; $G^1$ is selected from the group consisting of glucose and/or xylose, and x is in the range of from 1.05 to 2.5 and refers to average values.

For example, in the composition comprising two or more compounds of the general formula (I),

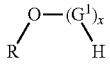

(I)

R is unsubstituted branched $C_{13}$-alkyl; $G^1$ is selected from the group consisting of glucose and/or xylose, and x is in the range of from 1.10 to 1.8 and refers to average values.

In one embodiment, R differs in the branching across the length of the carbon backbone. Accordingly, R is a mixture of different unsubstituted branched $C_{13}$-alkyl.

If said composition comprising two or more compounds of the general formula (I) is used as degreasing agent or emulsifying agent, in the compound of the general formula (I)

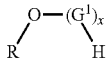

(I)

R is preferably unsubstituted branched $C_{13}$-alkyl; $G^1$ is xylose, and x is in the range of from 1.10 to 1.8 and refers to average values.

It is preferred that R differs in the branching across the length of the carbon backbone. Accordingly, R is a mixture of different unsubstituted branched $C_{13}$-alkyl.

If said composition comprising two or more compounds of the general formula (I) is used as wetting agent, in the compound of the general formula (I)

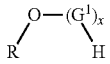

(I)

R is preferably unsubstituted branched $C_{13}$-alkyl; $G^1$ is glucose, and x is in the range of from 1.10 to 1.8 and refers to average values.

It is preferred that R differs in the branching across the length of the carbon backbone. Accordingly, R is a mixture of different unsubstituted branched $C_{13}$-alkyl.

It is appreciated that two or more compounds of the general formula (I) are provided in the composition.

If the composition comprises, preferably consists of, two or more compounds of general formula (I), the two or more compounds present in the composition differ in the groups R and/or $G^1$ and/or x in the general formula (I). That is to say, the groups R and/or $G^1$ and/or x can be independently selected from each other.

For example, if the composition comprises, preferably consists of, two or more compounds of general formula (I), R may be independently selected from unsubstituted branched $C_9$-$C_{15}$-alkyl, preferably unsubstituted branched $C_9$-$C_{13}$-alkyl, more preferably unsubstituted branched $C_9$- or $C_{10}$- or $C_{13}$-alkyl, and most preferably unsubstituted branched $C_{10}$- or $C_{13}$-alkyl, while $G^1$ and x in the general formula (I) are the same for each compound. Alternatively, x may be independently selected from the range of from 1 to 10, preferably from the range of from 1.05 to 2.5 and most preferably from the range of from 1.10 to 1.8, while R and $G^1$ in the general formula (I) are the same for each compound. Alternatively, $G^1$ may be independently selected from monosaccharides with 5 or 6 carbon atoms, more preferably from the group consisting of glucose, xylose, arabinose, rhamnose and mixtures thereof and most preferably from glucose and/or xylose, while R and x in the general formula (I) are the same for each compound.

Preferably, the two or more compounds of the general formula (I) differ in R. More preferably, the two or more compounds of the general formula (I) differ in R, while $G^1$ and x are the same. It is appreciated that the compounds of the general formula (I) can be present in the alpha and/or beta conformation. For example, the compound of general formula (I) is in the alpha or beta conformation, preferably alpha conformation. Alternatively, the compound of general formula (I) is in the alpha and beta conformation.

If the compound of general formula (I) is in the alpha and beta conformation, the compound of general formula (I) comprise the alpha and beta conformation preferably in a ratio (a/13) from 10:1 to 1:10, more preferably from 10:1 to 1:5, even more preferably from 10:1 to 1:4 and most preferably from 10:1 to 1:3, e.g. about 2:1 to 1:2.

The composition comprising two or more compounds of the general formula (I) can be preferably used in a dry or liquid formulation.

Thus, the present invention refers in a further aspect to a dry or liquid formulation comprising a composition comprising two or more compounds of the general formula (I).

As regards the composition comprising two or more compounds of the general formula (I), it is referred to the comments provided above when defining said composition and embodiments thereof in more detail.

For example, the dry or liquid formulation is a dry or liquid cleaning formulation.

The term "cleaning" is used herein in the broadest sense and means removal of unwanted substances such as oil- and/or fat-containing substances from an object to be cleaned, e.g. fabrics or dishes.

The term "dry formulation" as used herein, refers to formulations that are in a form of a powder, granules or tablets. It is appreciated that the "dry formulation" has a moisture content of ≥20 wt.-%, more preferably ≥15 wt.-%, even more preferably ≥10 wt.-% and most preferably ≥7.5 wt.-%, based on the total weight of the formulation. If not otherwise indicated, the moisture content is determined according to the Karl Fischer method as outlined in DIN EN 13267:2001. If the dry formulation is provided in form of a powder, the formulation is preferably a high concentrated powder formulation having a bulk density of above 600 g/l.

The term "liquid formulation" as used herein, refers to formulations that are in a form of a "pourable liquid"; "gel" or "paste".

A "pourable liquid" refers to a liquid formulation having a viscosity of <3 000 mPa·s at 25° C. at a shear rate of 20 $sec^{-1}$. For example, the pourable liquid has a viscosity in the range of from 200 to 2 000 mPa·s, preferably from 200 to 1 500 mPa·s and most preferably from 200 to 1 000 mPa·s, at 25° C. at a shear rate of 20 $sec^{-1}$.

A "gel" refers to a transparent or translucent liquid formulation having a viscosity of >2 000 mPa·s at 25° C. at a shear rate of 20 $sec^{-1}$. For example, the gel has a viscosity in the range of from 2 000 to about 10 000 mPa·s, preferably from 5 000 to 10 000 mPa·s, at a shear rate of 0.1 $sec^{-1}$.

A "paste" refers to an opaque liquid formulation having a viscosity of greater than about 2 000 mPa·s at 25° C. and a shear rate of 20 $sec^{1}$. For example, the paste has a viscosity in the range of from 3 000 to 10 000 mPa·s, preferably from 5 000 to 10 000 mPa·s, at 25° C. at a shear rate of 0.1 $sec^{-1}$.

Preferably the dry or liquid formulation, more preferably the dry or liquid cleaning formulation, is in form of a liquid formulation. The dry or liquid formulation is preferably in form of a single dose formulation. In one embodiment, the formulation is a high concentrated liquid formulation.

The dry or liquid formulation, preferably the dry or liquid cleaning formulation, comprises the composition comprising two or more compounds of the general formula (I) preferably in an amount ranging from 0.1 to 80 wt.-%, preferably from 0.1 to 50 wt.-% and most preferably from 0.1 to 25 wt.-%, based on the total weight of the formulation.

It is appreciated that the dry or liquid formulation, preferably the dry or liquid cleaning formulation, may further comprise additives typically used in the kind of formulation to be prepared. For example, the dry or liquid formulation, preferably the dry or liquid cleaning formulation, further comprises additives selected from the group comprising anionic surfactants, nonionic surfactants, cationic surfactants, amphoteric surfactants, enzymes, bleaching agents, peroxygen compounds, optical brightener, complexing agents, polymers, soaps, silicon based defoamers, bleaching agents, colorants, dye transfer inhibitors and mixtures thereof.

Additionally or alternatively, the dry or liquid cleaning formulation may comprise a bleach activator as additive. Bleach activators are well known in the art and can be chosen accordingly.

Anionic surfactants suitable for the dry or liquid formulation, preferably the dry or liquid cleaning formulation, can be of several different types. For example, the anionic surfactant can be selected from the group comprising alkane sulfonates, olefin sulfonates, fatty acid ester sulfonates, especially methyl ester sulfonates, alkyl phosphonates, alkyl ether phosphonates, sarcosinates, taurates, alkyl ether carboxylates, fatty acid isothionates, sulfosuccinates, $C_8$-$C_{22}$ alkyl sulfates, $C_8$-$C_{22}$ alkyl alkoxy sulfates, $C_{11}$-$C_{13}$ alkyl benzene sulfonate, $C_{12}$-$C_{20}$ methyl ester sulfonate, $C_{12}$-$C_{18}$ fatty acid soap and mixtures thereof.

Nonionic surfactants suitable for the dry or liquid formulation, preferably the dry or liquid cleaning formulation, can be of several different types. For example, the nonionic surfactant can be selected from the group comprising $C_8$-$C_{22}$ alkyl ethoxylates, $C_6$-$C_{12}$ alkyl phenol alkoxylates, preferably ethoxylates and mixed ethoxy/propoxy, block alkylene oxide condensate of $C_6$ to $C_{12}$ alkyl phenols, alkylene oxide condensates of $C_8$-$C_{22}$ alkanols and ethylene oxide/propylene oxide block polymers, alkylpolysaccharides, alkyl polyglucoside surfactants, condensation products of $C_{12}$-$C_{15}$ alcohols with from 5 to 20 moles of ethylene oxide per mole of alcohol, polyhydroxy fatty acid amides, preferably N-methyl N-1-deoxyglucityl cocoamide or N-methyl N-1-deoxyglucityl oleamide, and mixtures thereof. In one embodiment, the nonionic surfactant may be of the formula $R^1(OC_2H_4)_nOH$, wherein $R^1$ is a $C_{10}$-$C_{16}$ alkyl group or a $C_8$-$C_{12}$ alkyl phenyl group, and wherein n is from 3 to about 80.

Additionally or alternatively, the non-ionic surfactant can be a biosurfactant selected from the group comprising rhamnolipid, sophorolipid, glucoselipid, celluloselipid, trehaloselipid, mannosylerythritollipid, lipopeptide and mixtures thereof.

Preferred non-ionic surfactants are glucamides, methylesteralkoxylates, alkoxylated alcohols, di- and multiblock copolymers of ethylene oxide and propylene oxide and reaction products of sorbitan with ethylene oxide or propylene oxide, alkyl polyglycosides (APG), hydroxyalkyl mixed ethers and amine oxides.

Preferred examples of alkoxylated alcohols and alkoxylated fatty alcohols are, for example, compounds of the general formula (III)

(III)

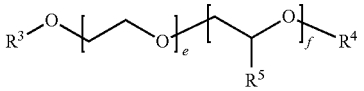

in which the variables are defined as follows:

$R^3$ is selected from $C_{08}$-$C_{22}$-alkyl, branched or linear, for example n-$C_8H_{17}$, n-$C_{10}H_{21}$, n-$C_{12}H_{25}$, n-$C_{14}H_{29}$, n-$C_{16}H_{33}$ or n-$C_{18}H_{37}$, $R^4$ is selected from $C_1$-$C_{10}$-alkyl, methyl, ethyl, n-propyl, isopropyl, n-butyl, isobutyl, sec-butyl, tert-butyl, n-pentyl, isopentyl, sec-pentyl, neopentyl, 1,2-dimethylpropyl, isoamyl, n-hexyl, isohexyl, sec-hexyl, n-heptyl, n-octyl, 2-ethylhexyl, n-nonyl, n-decyl or isodecyl, $R^5$ is identical or different and selected from hydrogen and linear $C_1$-$C_{10}$-alkyl, preferably in each case identical and ethyl and particularly preferably hydrogen or methyl, e and f are in the range from zero to 300, where the sum of e and f is at least one, preferably in the range of from 3 to 50. Preferably, e is in the range from 1 to 100 and f is in the range from 0 to 30.

It is appreciated that e and f may be polymerized randomly or as blocks.

In one embodiment, compounds of the general formula (III) may be block copolymers or random copolymers, preference being given to block copolymers.

Other preferred examples of alkoxylated alcohols are, for example, compounds of the general formula (IV)

(IV)

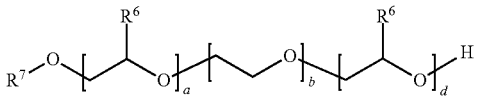

in which the variables are defined as follows:

$R^6$ is identical or different and selected from hydrogen and linear $C_1$-$C_{10}$-alkyl, preferably identical in each case and ethyl and particularly preferably hydrogen or methyl, $R^7$ is selected from $C_6$-$C_{20}$-alkyl, branched or linear, in particular n-$C_8H_{17}$, n-$C_{10}H_{21}$, n-$C_{12}H_{25}$, n-$C_{13}H_{27}$, n-$C_{15}H_{31}$, n-$C_{14}H_{29}$, n-$C_{16}H_{33}$, n-$C_{18}H_{37}$, a is a number in the range from zero to 10, preferably from 1 to 6, b is a number in the range from 1 to 80, preferably from 4 to 20, d is a number in the range from zero to 50, preferably 4 to 25.

The sum a+b+d is preferably in the range of from 5 to 100, even more preferably in the range of from 9 to 50.

Compounds of the general formula (III) and (IV) may be block copolymers or random copolymers, preference being given to block copolymers.

Further suitable nonionic surfactants are selected from di and multiblock copolymers, composed of ethylene oxide and propylene oxide. Further suitable nonionic surfactants are selected from ethoxylated or propoxylated sorbitan esters. Amine oxides or alkyl polyglycosides, especially linear $C_4$-$C_{16}$-alkyl polyglucosides and branched $C_8$-$C_{14}$-alkyl polyglycosides such as compounds of general average formula (VI) are likewise suitable.

(VI)

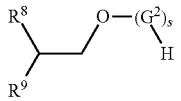

wherein:

$R^8$ is $C_1$-$C_4$-alkyl, in particular ethyl, n-propyl or isopropyl, $R^9$ is —$(CH_2)_2$—$R^7$, $G^2$ is selected from monosaccharides with 4 to 6 carbon atoms, especially from glucose and xylose, s in the range of from 1.1 to 4, s being an average number, Further examples of non-ionic surfactants are compounds of general formula (VII) and (VIII)

(VII)

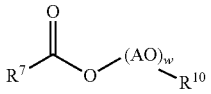

(VIII)

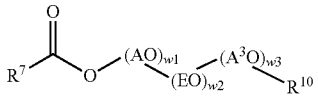

$R^7$ is defined as above in general formula (IV).

AO corresponds to the group f as defined above in general formula (III) or the group a or d as defined above in general formula (IV).

$R^{10}$ selected from $C_8$-$C_{18}$-alkyl, branched or linear.

$A^3O$ is selected from propylene oxide and butylene oxide, w is a number in the range of from 15 to 70, preferably 30 to 50, w1 and w3 are numbers in the range of from 1 to 5, and w2 is a number in the range of from 13 to 35.

An overview of suitable further nonionic surfactants can be found in EP-A 0 851 023 and in DE-A 198 19 187 which are incorporated herewith by reference.

Mixtures of two or more different nonionic surfactants selected from the foregoing may also be present.

Cationic surfactants suitable for the dry or liquid formulation, preferably the dry or liquid cleaning formulation, can be of several different types. For example, useful cationic surfactants can be selected from fatty amines, quaternary ammonium surfactants, imidazoline quat materials and mixtures thereof.

Amphoteric surfactants are also suitable for use in the dry or liquid formulation, preferably the dry or liquid cleaning formulation, and can be of several different types. For example, the amphoteric surfactants can be selected from aliphatic derivatives of secondary or tertiary amines and/or aliphatic derivatives of heterocyclic secondary and tertiary amines in which the aliphatic radical can be a straight- or branched-chain. It is preferred that one of the aliphatic substituents contains at least 8 carbon atoms, preferably from 8 to 18 carbon atoms, and at least one contains an anionic water-solubilizing group, e.g., a carboxy, sulfonate or sulfate group.

The present dry or liquid formulation, preferably the dry or liquid cleaning formulation, may also comprise enzymes, such as for the removal of protein-based, carbohydrate-based or triglyceride-based stains. For example, suitable enzymes are selected from the group comprising hemicellulases, peroxidases, proteases, cellulases, xylanases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, laccase, amylases, and mixtures thereof. They may be of any suitable origin, such as vegetable, animal, bacterial, fungal and yeast origin.

In one embodiment, the dry or liquid formulation, preferably the dry or liquid cleaning formulation, comprises a mixture of conventional enzymes like protease, lipase, cutinase and/or cellulase in combination with amylase.

Proteases useful herein include those like subtilisins from *Bacillus* [e.g. *subtilis, lentus, licheniformis, amyloliquefaciens* (BPN, BPN'), *alcalophilus*] such as the commercial products Esperase®, Alcalase®, Everlase® or Savinase® available from Novozymes. Commercial products of amylases (a and/or 13) are for example available as Purafect Ox Am® from Genencor or Termamyl®, Natalase®, Ban®, Fungamyl® and Duramyl® from Novozymes. Suitable lipases include those produced by *Pseudomonas* and *Chromobacter* groups. The lipolase enzymes can be derived from *Humicola lanuginosa* and are commercially available from Novo or as Lipolase Ultra®, Lipoprime® and Lipex® from Novozymes. Also suitable are cutinases and esterases. Suitable cellulases include both bacterial and fungal types, typically having a pH optimum between 5 and 10. Examples include fungal cellulases from *Humicola insolens* or *Humicola* strain DSMI 800 or a cellulase 212-producing fungus belonging to the genus *Aeromonas*, and cellulase extracted from the hepatopancreas of a marine mollusk, Dolabella Auricula Solander. CAREZYME® ENDOLASE and CELLUZYME® of Novozymes or the EGIII cellulases from *Trichoderma longibrachiatum* are also suitable.

Bleaching enzymes can be used as bleaching agents e.g. peroxidases, laccases, oxygenases, e.g. catechol 1,2 dioxygenase, lipoxygenase, (non-heme) haloperoxidases.

The peroxygen compounds that can be used in the present dry or liquid formulation, preferably the dry or liquid cleaning formulation, are normally compounds which are capable of yielding hydrogen peroxide in aqueous solution and are well known in the art. For example, the peroxygen compounds can be selected from the group comprising alkali metal peroxides, organic peroxides such as urea peroxide, and inorganic persalts, such as the alkali metal perborate such as sodium perborate tetrahydrate or sodium perborate monohydrate, percarbonates, perphosphates, persilicates, alkylhydroxy peroxides such as cumene hydroperoxide or t-butyl hydroperoxide, organic peroxyacids such as monoperoxy acids (e.g. peroxy-α-naphthoic acid, peroxylauric acid, peroxystearic acid and N,N-phthaloylaminoperoxy caproic acid (PAP), 6-octylamino-6-oxo-peroxyhexanoic acid, 1,12-diperoxydodecanedioic acid (DPDA), 2-decylperoxybutane-1,4-dioic acid or 4,4'-sulphonylbisperoxybenzoic acid) and mixtures thereof.

Optical brighteners include any compound that exhibits fluorescence, including compounds that absorb UV light and reemit as "blue" visible light. In particular, suitable optical brighteners absorb light in the ultraviolet portion of the spectrum between about 275 nm and about 400 nm and emit light in the violet to violet-blue range of the spectrum from about 400 nm to about 500 nm. For example, the optical brighteners contain an uninterrupted chain of conjugated double bonds. Examples of suitable optical brighteners include derivatives of stilbene or 4,4'-diaminostilbene, biphenyl, five-membered heterocycles such as triazoles, oxazoles, imidiazoles, etc., or six-membered heterocycles (e.g. coumarins, naphthalamide, s-triazine, etc.). Cationic, anionic, nonionic, amphoteric and zwitterionic optical brightener can be used in the present dry or liquid formulation, preferably the dry or liquid cleaning formulation.

The present dry or liquid formulation, preferably the dry or liquid cleaning formulation, may also comprise complexing agents, e.g. iron and manganese complexing agents. Such complexing agents can be selected from the group comprising amino carboxylates, amino phosphonates, polyfunctionally-substituted aromatic complexing agents and mixtures thereof. Suitable complexing agents are selected from the alkali metal salts of aminocarboxylic acids and from alkali metal salts of citric acid, tartaric acid and lactic acid. Alkali metal salts are selected from lithium salts, rubidium salts, cesium salts, potassium salts and sodium salts, and combinations of at least two of the foregoing. Potassium salts and combinations from potassium and sodium salts are preferred and sodium salts are even more preferred.

Examples of aminocarboxylic acids are imino disuccinic acid (IDS), ethylene diamine tetraacetic acid (EDTA), nitrilotriacetic acid (NTA), methylglycine diacetic acid (MGDA) and glutamic acid diacetic acid (GLDA).

In one embodiment of the present invention, formulations according to the invention can contain at least one organic complexing agent (organic cobuilders) such as EDTA (N,N,N',N'-ethylenediaminetetraacetic acid), NTA (N,N,N-nitrilotriacetic acid), MGDA (2-methylglycine-N,N-diacetic acid), GLDA (glutamic acid N,N-diacetic acid), and phosphonates such as 2-phosphono-1,2,4-butanetricarboxylic acid, aminotri(methylenephosphonic acid), 1-hydroxyethylene(1,1-diphosphonic acid) (HEDP), ethylenediaminetetramethylenephosphonic acid, hexamethylenediaminetetramethylenephosphonic acid and diethylenetriaminepentamethylenephosphonic acid and in each case the respective alkali metal salts, especially the respective sodium salts. Preferred are the sodium salts of HEDP, of GLDA and of MGDA.

The present dry or liquid formulation, preferably the dry or liquid cleaning formulation, may also comprise polymers, e.g. polycarboxylates.

The dry or liquid formulation, preferably the dry or liquid cleaning formulation, preferably comprises one or more of the above additives (in sum) in an amount ranging from 0.5 to 25 wt.-%, preferably from 0.5 to 20 wt.-% and most preferably from 0.5 to 17.5 wt.-%, based on the total weight of the active materials in the formulation. It is to be noted that the total weight of the active materials in the formulation (if not otherwise indicated) refers to the total weight of the one or more additives and the compound of the general formula (I), i.e. without water.

It is appreciated that the composition comprising two or more compounds of the general formula (I), (I)

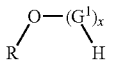

wherein R is unsubstituted branched $C_9$-$C_{15}$-alkyl, $G^1$ is selected from monosaccharides with 5 or 6 carbon atoms; x is in the range of from 1 to 10 and refers to average values, and wherein the two or more compounds differ in R and/or $G^1$ and/or x, shows exceptional results when used as degreasing agent for removing greasy and/or oil type deposits. In an alternative embodiment, the composition comprising two or more compounds of the general formula (I) shows exceptional results when used as degreasing agent for removing engine oils, mineral oils, shoe cream, shoe polish, sebum, wool grease, cosmetic stains such as lipstick, solid, pasty or liquid make-up and food stains, especially food stains comprising oil-type components such as plant oils, e.g. olive oil, frying fat, curry oil, soybean oil, soy sauce, chocolate, chocolate mousse, cacao, salat sauce, butter fat, mayonnaise, milk, beef fat, tallow and the like.

Thus, the present invention refers in another aspect to the use of the composition comprising two or more compounds of the general formula (I)

(I)

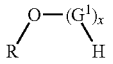

wherein R is unsubstituted branched $C_9$-$C_{15}$-alkyl, $G^1$ is selected from monosaccharides with 5 or 6 carbon atoms; x is in the range of from 1 to 10 and refers to average values, and wherein the two or more compounds differ in R and/or $G^1$ and/or x, as degreasing agent for removing greasy and/or oil type deposits.

According to a further aspect, the use of the composition comprising two or more compounds of the general formula (I)

(I)

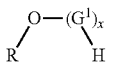

wherein R is unsubstituted branched $C_9$-$C_{15}$-alkyl, $G^1$ is selected from monosaccharides with 5 or 6 carbon atoms; x is in the range of from 1 to 10 and refers to average values, and wherein the two or more compounds differ in R and/or $G^1$ and/or x, as degreasing agent for removing engine oils, mineral oils, shoe cream, shoe polish, sebum, wool grease, cosmetic stains such as lipstick, solid, pasty or liquid make-up and food stains, especially food stains comprising oil-type components such as plant oils, e.g. olive oil, frying fat, curry oil, soybean oil, soy sauce, chocolate, chocolate mousse, cacao, salat sauce, butter fat, mayonnaise, milk, beef fat, tallow and the like is provided.

As regards the composition comprising two or more compounds of the general formula (I), it is referred to the comments provided above when defining said composition and embodiments thereof in more detail.

Preferably, the composition comprising two or more compounds of the general formula (I) is used as degreasing agent for removing greasy type deposits.

It is appreciated that the removal of the greasy and/or oil type deposits is especially achieved at low temperature operations. Thus, the composition comprising two or more compounds of the general formula (I) is preferably used as degreasing agent for removing greasy and/or oil type deposits, preferably greasy type deposits, at temperatures of ≥40° C., preferably in the range from 5 to 40° C. In view of this, the composition comprising two or more compounds of the general formula (I) is preferably used as degreasing agent in home care laundry products, industrial laundry products, manual dishwashing, enhanced oil recovery and the like, most preferably home care laundry products.

In one especially preferred embodiment, in the composition comprising two or more compounds of the general formula (I) which is/are used as degreasing agent, (I)

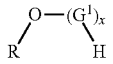

R is unsubstituted branched $C_{13}$-alkyl; $G^1$ is xylose, and x is in the range of from 1.10 to 1.8 and refers to average values.

It is preferred that R differs in the branching across the length of the carbon backbone. Accordingly, R is a mixture of different unsubstituted branched $C_{13}$-alkyl.

The composition comprising two or more compounds of the general formula (I), (I)

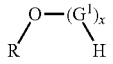

wherein R is unsubstituted branched $C_9$-$C_{15}$-alkyl, $G^1$ is selected from monosaccharides with 5 or 6 carbon atoms; x is in the range of from 1 to 10 and refers to average values, and wherein the two or more compounds differ in R and/or $G^1$ and/or x, shows exceptional results when used as emulsifying agent.

Thus, the present invention refers in a further aspect to the use of the composition comprising two or more compounds of the general formula (I)

(I)

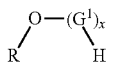

wherein R is unsubstituted branched $C_9$-$C_{15}$-alkyl, $G^1$ is selected from monosaccharides with 5 or 6 carbon atoms; x is in the range of from 1 to 10 and refers to average values, and wherein the two or more compounds differ in R and/or $G^1$ and/or x, as emulsifying agent.

As regards the composition comprising two or more compounds of the general formula (I), it is referred to the comments provided above when defining said composition and embodiments thereof in more detail.

It is appreciated that the formed emulsions are stable over time, i.e. no phase separation is recognizable, e.g. for more than 20 min, preferably more than 45 min, more preferably more than 1 hour, even more preferably more than 2 hours, still more preferably more than 3 hours and most preferably more than 4 hours, e.g. from 1 to 10 hours.

In one especially preferred embodiment, in the composition comprising two or more compounds of the general formula (I) which is used as emulsifying agent

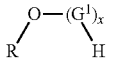

(I)

R is unsubstituted branched $C_{13}$-alkyl; $G^1$ is xylose, and x is in the range of from 1.10 to 1.8 and refers to average values.

It is preferred that R differs in the branching across the length of the carbon backbone. Accordingly, R is a mixture of different unsubstituted branched $C_{13}$-alkyl.

Thus, the composition comprising two or more compounds of the general formula (I) is preferably used as emulsifying agent in home care laundry products, industrial laundry products, manual dishwashing, enhanced oil recovery and the like.

It is appreciated that the composition comprising two or more compounds of the general formula (I),

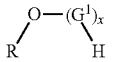

(I)

wherein R is unsubstituted branched $C_9$-$C_{15}$-alkyl, $G^1$ is selected from monosaccharides with 5 or 6 carbon atoms; x is in the range of from 1 to 10 and refers to average values, and wherein the two or more compounds differ in R and/or $G^1$ and/or x, shows exceptional results when used as wetting agent.

Thus, the present invention refers in another aspect to the use of the composition comprising two or more compounds of the general formula (I)

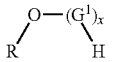

(I)

wherein R is unsubstituted branched $C_9$-$C_{15}$-alkyl, $G^1$ is selected from monosaccharides with 5 or 6 carbon atoms; x is in the range of from 1 to 10 and refers to average values, and wherein the two or more compounds differ in R and/or $G^1$ and/or x, as wetting agent.

As regards the composition comprising two or more compounds of the general formula (I), it is referred to the comments provided above when defining said composition and embodiments thereof in more detail.

It is appreciated that the composition comprising two or more compounds of the general formula (I) shows exceptional results as wetting agent when used at high temperature operations. Thus, the composition comprising two or more compounds of the general formula (I) is preferably used as wetting agent at temperatures of ≥40° C., preferably in the range from 40 to 120° C. In view of this, the composition comprising two or more compounds of the general formula (I) is preferably used as wetting agent in industrial laundry products and/or operations, home care laundry products, manual dishwashing, enhanced oil recovery and the like, most preferably industrial laundry products and/or operations.

In one especially preferred embodiment, in the composition comprising two or more compounds of the general formula (I) which is used as wetting agent,

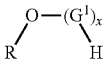

(I)

R is unsubstituted branched $C_{13}$-alkyl; $G^1$ is glucose, and x is in the range of from 1.10 to 1.8 and refers to average values.

It is preferred that R differs in the branching across the length of the carbon backbone. Accordingly, R is a mixture of different unsubstituted branched $C_{13}$-alkyl.

The scope and interest of the invention will be better understood based on the following examples which are intended to illustrate certain embodiments of the invention and are non-limitative.

EXAMPLES

Example 1

Figure 1:
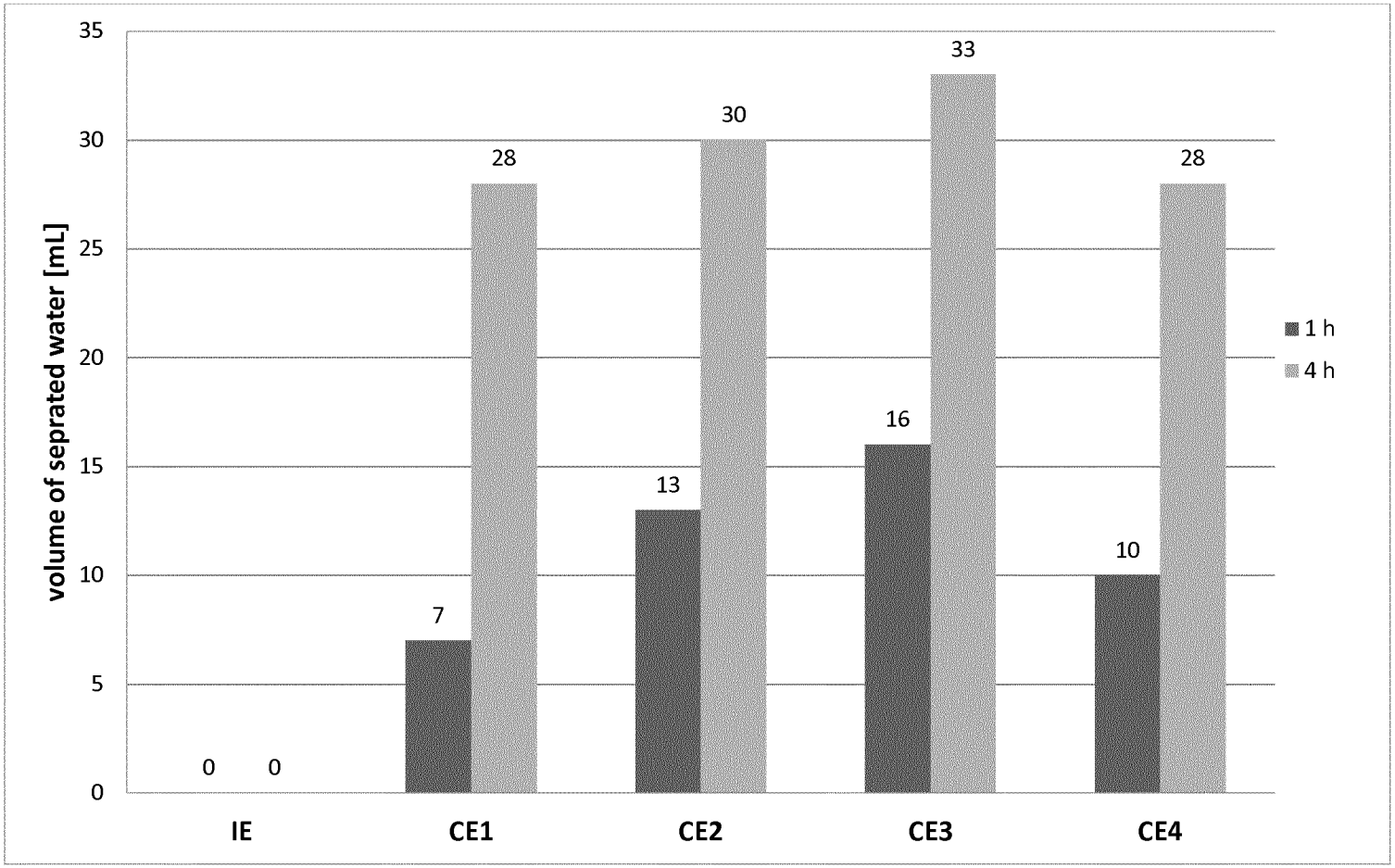
FIG. 1 shows the emulsifying properties of the inventive composition comprising two or more compounds of the general formula (I) in comparison to compounds of the prior art.

The degreasing properties of the composition comprising two or more compounds of formula (I) were demonstrated by using the launder-o-meter or a washing machine in comparison to compounds of the prior art.

The washing performance for the selected composition comprising two or more compounds of formula (I) was determined in the launder-o-meter and washing machine as follows:

a) Launder-o-meter

Several soil swatches were washed together with cotton ballast fabric and 20 steel balls at 25° C. in water in the launder-o-meter with the selected composition comprising two or more compounds of formula (I) or comparative compound. The compositions comprising two or more compounds used as well as the comparative compounds are outlined in tables 1a and 1 b. After the washing, the fabrics were rinsed, spin-dried and dried in the air.

TABLE 1a

Tested compounds and results for a washing time of 60 min

| | Fabric | Remission after washing [%] | Δ (remission difference to reference) |
|---|---|---|---|
| Reference (only water) | CFT-CS 62 | 37.7 | — |
| nC12-C14 Glucosid (CE1) | CFT-CS 62 | 43.1 | 5.4 |
| nC8-C10 Glucosid (CE2) | CFT-CS 62 | 38.6 | 0.9 |
| C13-C15 Oxo alcohol + 7 mol EO (CE3) | CFT-CS 62 | 34.8 | −2.9 |
| branched C10-Xylosid (IE1) | CFT-CS 62 | 49.9 | 12.2 |
| branched C13-Glucosid (IE2) | CFT-CS 62 | 50.5 | 12.8 |
| branched C13-Xylosid (IE3) | CFT-CS 62 | 49.7 | 12.0 |
| Reference (only water) | CFT-CS 61 | 23.5 | — |
| nC12-C14 Glucosid (CE4) | CFT-CS 61 | 33.0 | 9.5 |
| nC8-C10 Glucosid (CE5) | CFT-CS 61 | 24.9 | 1.4 |
| C13-C15 Oxo alcohol + 7 mol EO (CE6) | CFT-CS 61 | 22.9 | −0.7 |
| branched C10-Xylosid (IE4) | CFT-CS 61 | 55.1 | 31.6 |
| branched C13-Glucosid (IE5) | CFT-CS 61 | 51.5 | 28.0 |
| branched C13-Xylosid (IE6) | CFT-CS 61 | 53.3 | 29.8 |

TABLE 1b

Tested compounds and results for a washing time of 20 min

| | Fabric | Remission after washing [%] | Δ (remission difference to reference) |
|---|---|---|---|
| Reference (only water) | CFT-CS 62 | 38.0 | — |
| nC12-C14 Glucosid (CE7) | CFT-CS 62 | 36.4 | −1.6 |
| nC8-C10 Glucosid (CE8) | CFT-CS 62 | 35.2 | −2.8 |
| C13-C15 Oxo alcohol + 7 mol EO (CE9) | CFT-CS 62 | 33.5 | −4.5 |
| branched C10-Xylosid (IE7) | CFT-CS 62 | 49.8 | 11.8 |
| branched C13-Glucosid (IE8) | CFT-CS 62 | 49.9 | 11.9 |
| branched C13-Xylosid (IE9) | CFT-CS 62 | 47.9 | 9.9 |
| Reference (only water) | CFT-CS 61 | 19.9 | — |
| nC12-C14 Glucosid (CE10) | CFT-CS 61 | 32.6 | 12.7 |
| nC8-C10 Glucosid (CE11) | CFT-CS 61 | 22.8 | 2.9 |
| C13-C15 Oxo alcohol + 7 mol EO (CE12) | CFT-CS 61 | 21.6 | 1.7 |
| branched C10-Xylosid (IE10) | CFT-CS 61 | 53.1 | 33.2 |
| branched C13-Glucosid (IE11) | CFT-CS 61 | 49.2 | 29.3 |
| branched C13-Xylosid (IE12) | CFT-CS 61 | 50.3 | 30.4 |

The washing conditions are outlined in table 2 below.

TABLE 2

Washing conditions:

| | |
|---|---|
| Test equipment | Launder-o-meter, LP2 Typ, SDL Atlas Inc., USA |
| Washing liquor | 250 ml |
| Washing time/temperature | 20 min or 60 min at 25° C. |
| Dosage | 1 g tested compound/L |
| Fabric/liquor ratio | 1:12.5 |
| Washing cycles | 1 |
| Water hardness | 2.5 mmol/l $Ca^{2+}$:$Mg^{2+}$:$HCO_3^-$ 4:1:8 |
| Ballast fabric | 15 g cotton fabric 283 |
| Sum ballast + soiled fabric | 20 g |
| Soiled fabric | 5 g CFT-CS 62 [1)]<br>5 g CFT-CS 61 [2)] |

[1)] CFT-CS 62, cotton fabric soiled with lard, Remission 13.9% before wash

[2)] CFT-CS 61, cotton fabric soiled with beef fat, Remission 12.5% before wash

[1)2)] Producer: Center for Testmaterials BV, NL-3130 AC Vlaardingen

The washing performance was determined by measuring the remission value of the soiled fabric before and after washing with the spectrophotometer from Fa. Datacolor (Elrepho 2000) at 460 nm. The higher the value, the better is the performance. The results are also outlined in Tables 1a and 1 b above. From the results, it can be gathered that the inventive compositions comprising two or more compounds of formula (I) show excellent degreasing properties for removing greasy and/or oil type deposits compared to compounds of the prior art.

b) Washing Machine

Several soil swatches were washed together with cotton ballast fabric (3.5 kg) and 1 soil ballast sheet wfk SBL 2004 in a Miele Household washing machine at cotton program 20° C. with the selected composition comprising two or more compounds of formula (I) or comparative compound. The compositions comprising two or more compounds used as well as the comparative compounds are outlined in table 1c. In addition thereto, test samples further formulated with the enzyme lipase were prepared which are also outlined in table 1c. After the washing, the fabrics were dried in the air.

TABLE 1c

Tested compounds and results

| | Enzyme dosage Lipase [ppm] | Remission after washing for CFT-CS 61 [%] | Remission after washing for CFT-CS 61B [%] | Remission after washing for CFT-CS 62 [%] | Sum remission [%] | Δ (remission difference to reference) |
|---|---|---|---|---|---|---|
| Reference (formulation without tested compound) | — | 44.5 | 76.1 | 51.2 | 171.8 | — |
| branched C10-Xylosid (IE13) | — | 61.8 | 81.3 | 60.4 | 203.5 | 31.7 |
| branched C13-Glucosid (IE14) | — | 60.1 | 80.5 | 59.7 | 200.3 | 28.6 |
| branched C13-Xylosid (IE15) | — | 59.6 | 78.7 | 56.4 | 194.7 | 22.9 |
| C13-C15 Oxo alcohol + 7 mol EO (CE13) | — | 54.5 | 78.1 | 55.9 | 188.5 | 16.7 |

TABLE 1c-continued

| Tested compounds and results | | | | | | |
|---|---|---|---|---|---|---|
| | Enzyme dosage Lipase [ppm] | Remission after washing for CFT-CS 61 [%] | Remission after washing for CFT-CS 61B [%] | Remission after washing for CFT-CS 62 [%] | Sum remission [%] | Δ (remission difference to reference) |
| C12-C14 alcohol + 2 mol EO + sulfated Na-salt (C12-C14 ethersulfate) (CE14) | — | 46.9 | 74.8 | 52.8 | 174.5 | 2.7 |
| Reference (formulation without tested compound) | 0.8 | 56.6 | 77.1 | 57.3 | 191.0 | — |
| branched C10-Xylosid (IE16) | 0.8 | 59.5 | 78.9 | 58.9 | 197.3 | 6.3 |
| branched C13-Glucosid (IE17) | 0.8 | 58.5 | 78.5 | 56.5 | 193.5 | 2.5 |
| branched C13-Xylosid (IE18) | 0.8 | 63.9 | 80.8 | 60.7 | 205.4 | 14.4 |
| C13-C15 Oxo alcohol + 7 mol EO (CE15) | 0.8 | 44.8 | 71.3 | 50.5 | 166.6 | −24.4 |
| C12-C14 alcohol + 2 mol EO + sulfated Na-salt (C12-C14 ethersulfate) (CE16) | 0.8 | 46.4 | 78.7 | 53.7 | 178.7 | −12.2 |

The washing conditions are outlined in table 3 below.

TABLE 3

| Washing conditions: | |
|---|---|
| Test equipment | Miele Softtronic W1935 WTL |
| Washing program | Cotton 20° C., 1 200 U/min |
| Dosage | 71.25 g test formulation[4)] + 3.75 g tested compound |
| Washing cycles | 1 |
| Water hardness | 2.5 mmol/l $Ca^{2+}$:$Mg^{2+}$:$HCO_3^-$ 4:1:8 |
| Ballast fabric | 3.5 kg cotton towels<br>1 SBL 2004[3)] |
| Soiled fabric | CFT-CS 62 [1)]<br>CFT-CS 61 [2)]<br>CFT-CS 61 B [5)] |

[1)] CFT-CS 62, cotton fabric soiled with lard, Remission 13.9% before wash

[2)] CFT-CS 61, cotton fabric soiled with beef fat, Remission 12.5% before wash

[5)] CFT-CS 61 B, cotton fabric soiled with beef fat, Remission 41.2% before wash

[1)2)5)] Producer: Center for Testmaterials BV, NL-3130 AC Vlaardingen

[3)]Producer: wfk Testgewebe GmbH, Christenfeld 10, D-41379 Brueggen

[4)]composition of test formulation: 5.5 g Linear alkyl benzene sulfonic acid, 2.4 g coconut fatty acid C12-18, 5.4 g C12-C14 alcohol + 2 mol EO + sulfated Na-salt (C12-C14 ethersulfate), 2.2 g KOH, 5.4 g C13-C15 Oxo alcohol + 7 mol EO, 6.0 g 1,2-propylene glycol, 2.0 g ethanol and water to 80 g.

The washing performance was determined by measuring the remission value of the soiled fabric before and after washing with the spectrophotometer from Fa. Datacolor (Elrepho 2000) at 460 nm. The higher the value, the better is the performance. The results are outlined in Table 1c. From the results, it can be gathered that the inventive compositions comprising two or more compounds of formula (I) and optionally further comprising enzymes show excellent degreasing capabilities for removing greasy and/or oil type deposits compared to compounds of the prior art.

Example 2

The emulsifying properties of the composition comprising two or more compounds of formula (I) were demonstrated by using the stirring method in comparison to compounds of the prior art. The compositions and compounds used are outlined in table 4.

The stirring method was carried out at a water hardness of 0° dh or 16° dh. 50 g of an aqueous homogenous surfactant solution comprising an amount of 2 wt.-%, based on the total weight of the solution, of active substance, i.e. the emulsifying agent to be tested, was prepared. Then, this solution is covered by 50 g olive oil (commercially available from Sigma Aldrich). Subsequently, the solutions were stirred for exactly 2 min at a temperature of 25° C. with a stirring speed of 1 200 rpm (±3 rpm). The stirrer (four blade propeller stirrer Ø=50 mm (IKA Typ R 1342)) was positioned at the phase boundary. Finally, the prepared emulsion was transferred to a 250 mL measuring cylinder (calibrated up to the bottom) and the volume of separated water was determined after 1 and 4 hours. The measuring cylinder was not moved during measuring. The results are outlined in table 4 and FIG. 1.

TABLE 4

| Tested compounds and results | | | |
|---|---|---|---|
| | Olive oil (25° C.) [mL] | | x (degree of polymerization) |
| | 1 h | 4 h | |
| branched C13-Xylosid (IE) | 0 | 0 | 1.3 |
| nC12-14 Glucosid (CE1) | 7 | 28 | 1.5 |
| nC8-10 Glucosid (CE2) | 13 | 30 | 1.5 |
| 2-Propylheptanol + 1.5 mol PO + 8 mol EO (CE3) | 16 | 33 | — |
| Isotridecanol + 8 mol EO (CE4) | 10 | 28 | — |

From table 4, it can be gathered that the inventive branched $C_{13}$-xylosid shows excellent emulsifying properties compared to compounds of the prior art.

Example 3

The wetting properties of the composition comprising two or more compounds of formula (I) were determined according to DIN EN 1772 on a German fabric according to annex A. Furthermore, distilled water was used as solvent and the composition comprising two or more compounds of formula (I) was used in an amount of 1 g/L, based on the active material. The DIN EN norm was further adapted in that the wetting properties were measured at the respective temperature set out in table 5.

Figure 2:
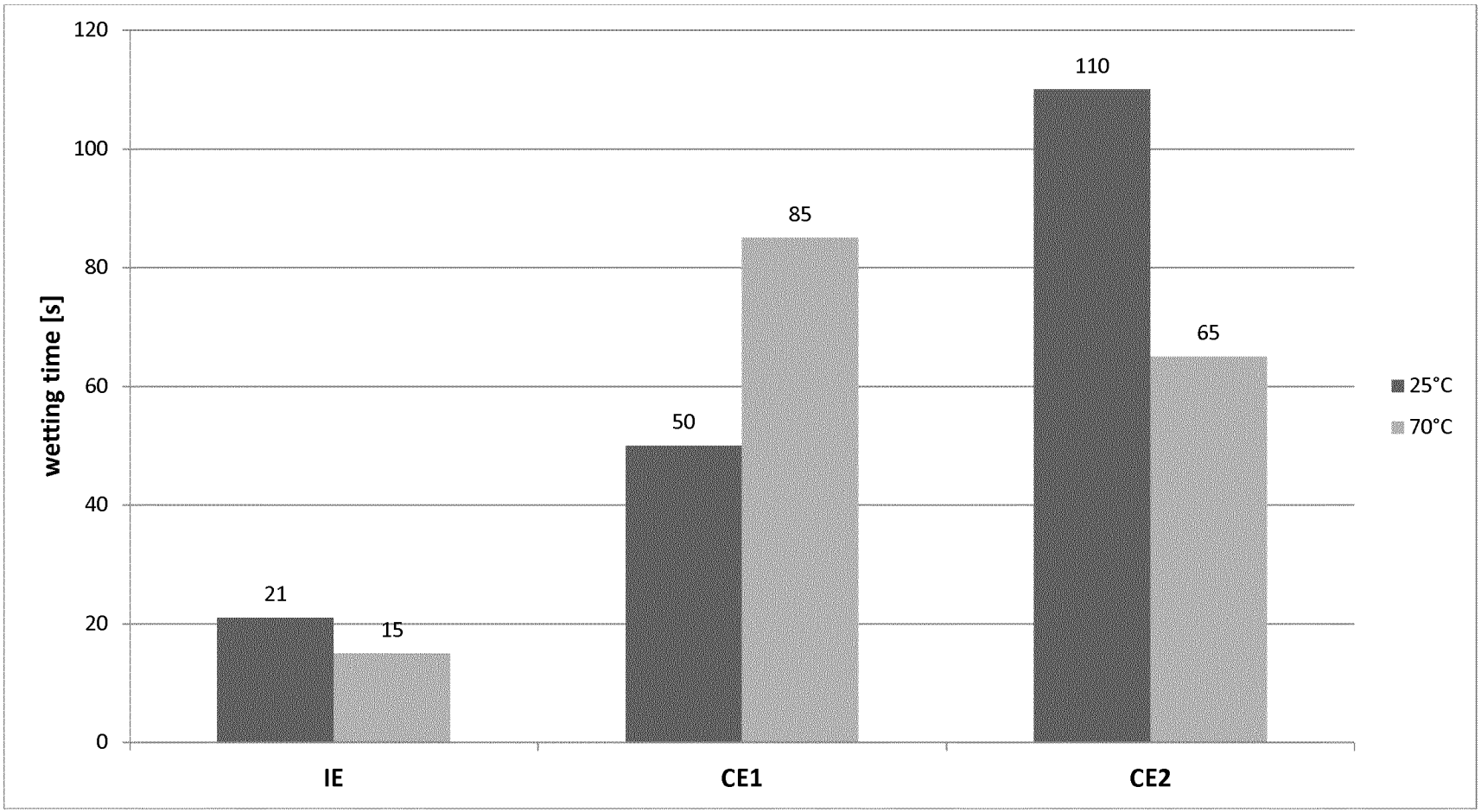
FIG. 2 shows the wetting properties of the inventive composition comprising two or more compounds of the general formula (I) in comparison to compounds of the prior art.

The composition comprising two or more compounds of formula (I), the compounds of the prior art as well as the results achieved are outlined in table 5 and FIG. 2.

TABLE 5

Tested compounds and results

| | Wetting time [s] | | x (degree of |
|---|---|---|---|
| | 25° C. | 70° C. | polymerization) |
| branched C13-Glycosid (IE) | 21 ± 1 | 15 ± 1 | 1.3 |
| nC12-14 Glucosid (CE1) | 50 ± 2 | 85 ± 2 | 1.5 |
| nC8-10 Glucosid (CE2) | 110 ± 2 | 65 ± 2 | 1.5 |

From table 5, it can be gathered that the inventive branched $C_{13}$-glycosid shows excellent wetting properties compared to compounds of the prior art.

Example 4

The efficiency of the composition comprising two or more compounds of formula (I) as surfactant was demonstrated by using the launder-o-meter in comparison to compounds of the prior art.

The surfactant efficiency for the selected composition comprising two or more compounds of formula (I) was determined in the launder-o-meter as follows:

Several soil swatches were washed together with cotton ballast fabric and 20 steel balls at 25° C. for 20 min in water in the launder-o-meter with the selected composition comprising two or more compounds of formula (I) or comparative compound. The compositions comprising two or more compounds used as well as the comparative compounds are outlined in tables 6a and 6b for surfactant dosages of 0.1 g/L and 1 g/L. After the washing, the fabrics were rinsed, spin-dried and dried in the air.

TABLE 6a

Tested compounds and results for a surfactant dosage of 0.1 g/L

| | Fabric | Remission before washing [%] | Remission after washing [%] | Δ (remission difference before and after washing) | ΔΔ (remission difference to reference) |
|---|---|---|---|---|---|
| Reference (only water) | CFT-CS 62 | 14.7 | 31.1 | 16.4 | — |
| C13-C15 Oxo alcohol + 7 mol EO[#] (CE1) | CFT-CS 62 | 14.7 | 29.6 | 14.9 | −1.5 |
| branched C13-Xylosid[#1] (IE1) | CFT-CS 62 | 14.7 | 34.3 | 19.6 | 3.2 |
| branched C13-Xylosid[#2] (IE2) | CFT-CS 62 | 14.7 | 36.1 | 21.4 | 5.0 |
| Reference (only water) | CFT-CS 61 | 14.5 | 25.7 | 11.2 | — |
| C13-C15 Oxo alcohol + 7 mol EO[#] (CE2) | CFT-CS 61 | 14.5 | 30.1 | 15.6 | 4.4 |
| branched C13-Xylosid[#1] (IE3) | CFT-CS 61 | 14.5 | 40.9 | 26.4 | 15.2 |
| branched C13-Xylosid[#2] (IE4) | CFT-CS 61 | 14.5 | 43.2 | 28.7 | 17.5 |

[#]active content: 100 wt.-%, based on the total weight of the surfactant.
[#1]active content: 55 wt.-%, based on the total weight of the surfactant.
[#2]active content: 50 wt.-%, based on the total weight of the surfactant.

TABLE 6b

Tested compounds and results for a surfactant dosage of 1 g/L

| | Fabric | Remission before washing [%] | Remission after washing [%] | Δ (remission difference before and after washing) | ΔΔ (remission difference to reference) |
|---|---|---|---|---|---|
| Reference (only water) | CFT-CS 62 | 14.7 | 31.1 | 16.4 | — |
| C13-C15 Oxo alcohol + 7 mol EO[#] (CE3) | CFT-CS 62 | 14.7 | 28.7 | 14.0 | −2.4 |
| branched C13-Xylosid[#1] (IE5) | CFT-CS 62 | 14.7 | 49.2 | 34.5 | 18.1 |
| branched C13-Xylosid[#2] (IE6) | CFT-CS 62 | 14.7 | 47.1 | 32.4 | 16.0 |
| branched C13-Arabinosid[#3] (IE7) | CFT-CS 62 | 14.7 | 48.3 | 33.6 | 17.2 |
| branched C13-Glycosid (66% Glucose/33% Xylose/1% Arabinose)[#4] (IE8) | CFT-CS 62 | 14.7 | 47.7 | 33.0 | 16.6 |
| Reference (only water) | CFT-CS 61 | 14.5 | 25.7 | 11.2 | — |

TABLE 6b-continued

Tested compounds and results for a surfactant dosage of 1 g/L

| | Fabric | Remission before washing [%] | Remission after washing [%] | Δ (remission difference before and after washing) | ΔΔ (remission difference to reference) |
|---|---|---|---|---|---|
| C13-C15 Oxo alcohol + 7 mol EO[#] (CE4) | CFT-CS 61 | 14.5 | 28.2 | 13.7 | 2.5 |
| branched C13-Xylosid[#1] (IE9) | CFT-CS 61 | 14.5 | 51.3 | 36.8 | 25.6 |
| branched C13-Xylosid[#2] (IE10) | CFT-CS 61 | 14.5 | 51.1 | 36.6 | 25.4 |
| branched C13-Arabinosid[#3] (IE11) | CFT-CS 61 | 14.5 | 50.5 | 36.0 | 24.8 |
| branched C13-Glycosid (66% Glucose/33% Xylose/1% Arabinose)[#4] (IE12) | CFT-CS 61 | 14.5 | 49.0 | 34.5 | 23.3 |

[#]active content: 100 wt.-%, based on the total weight of the surfactant.
[#1]active content: 55 wt.-%, based on the total weight of the surfactant.
[#2]active content: 50 wt.-%, based on the total weight of the surfactant.
[#3]active content: 44 wt.-%, based on the total weight of the surfactant.
[#4]active content: 43 wt.-%, based on the total weight of the surfactant.

The washing conditions are outlined in table 7 below.

TABLE 7

Washing conditions:

| | |
|---|---|
| Test equipment | Launder-o-meter, LP2 Typ, SDL Atlas Inc., USA |
| Washing liquor | 250 ml |
| Washing time/temperature | 20 min or 60 min at 25° C. |
| Dosage | 0.1 g or 1 g tested compound/L |
| Fabric/liquor ratio | 1:12.5 |
| Washing cycles | 1 |
| Water hardness | 2.5 mmol/l $Ca^{2+}$:$Mg^{2+}$:$HCO_3^-$ 4:1:8 |
| Ballast fabric | 15 g cotton fabric 283 |
| Sum ballast + soiled fabric | 20 g |
| Soiled fabric | 5 g CFT-CS 62 [1)]<br>5 g CFT-CS 61 [2)] |

[1)] CFT-CS 62, cotton fabric soiled with lard, Remission 13.9% before wash
[2)] CFT-CS 61, cotton fabric soiled with beef fat, Remission 12.5% before wash
[1)2)] Producer: Center for Testmaterials BV, NL-3130 AC Vlaardingen The efficiency as surfactant was determined by measuring the remission value of the soiled fabric before and after washing with the spectrophotometer from Fa. Datacolor (Elrepho 2000) at 460 nm. The higher the value, the better is the performance. The results are also outlined in Tables 6a and 6b above. From the results, it can be gathered that the inventive compositions comprising two or more compounds of formula (I) show excellent efficiency as surfactant compared to compounds of the prior art.

Example 5

The degreasing properties of the composition comprising two or more compounds of formula (I) with regard to chocolate mousse and lipstick were demonstrated by using the washing machine in comparison to compounds of the prior art. The washing performance for the selected composition comprising two or more compounds of formula (I) was determined in the washing machine as follows:

Several soil swatches were washed together with cotton ballast fabric (7 kg) and 2 soil ballast sheets wfk SBL 2004 in a Miele Household washing machine at cotton program 20° C. with the selected composition comprising two or more compounds of formula (I) or comparative compound. The cotton ballast fabric was neutralized beforehand with water at 60° C. The compositions comprising two or more compounds used as well as the comparative compounds are outlined in table 8. After the washing, the fabrics were dried in the air.

TABLE 8

Tested compounds and results for a washing time of 2:29 hours

| | Fabric | ΔE | ΔΔE |
|---|---|---|---|
| Reference (only water) | CFT-CS 70 | 12.8 | — |
| C13-C15 Oxo alcohol + 7 mol EO (CE1)[#] | CFT-CS 70 | 12.7 | −0.1 |
| branched C10-Xylosid (IE1)[#1] | CFT-CS 70 | 14.1 | 1.3 |
| branched C13-Glucosid (IE2)[#2] | CFT-CS 70 | 13.6 | 0.8 |
| branched C13-Xylosid (IE3)[#3] | CFT-CS 70 | 14.9 | 2.1 |
| Reference (only water) | KC-H021 | 45.5 | — |
| C13-C15 Oxo alcohol + 7 mol EO (CE2)[#] | KC-H021 | 41.0 | −4.5 |
| branched C10-Xylosid (IE4)[#1] | KC-H021 | 47.3 | 1.8 |
| branched C13-Xylosid (IE5)[#3] | KC-H021 | 50.1 | 4.6 |
| Reference (only water) | KC-H078 | 46.0 | — |
| C13-C15 Oxo alcohol + 7 mol EO (CE3)[#] | KC-H078 | 33.0 | −12.9 |
| branched C10-Xylosid (IE6)[#1] | KC-H078 | 48.5 | 2.5 |
| branched C13-Xylosid (IE7)[#3] | KC-H078 | 46.8 | 0.8 |

[#]active content: 100 wt.-%, based on the total weight of the degreasing agent.
[#1]active content: 52.9 wt.-%, based on the total weight of the degreasing agent.
[#2]active content: 49.1 wt.-%, based on the total weight of the degreasing agent.
[#3]active content: 60.9 wt.-%, based on the total weight of the degreasing agent.

The washing conditions are outlined in table 9 below.

TABLE 9

Washing conditions:

| | |
|---|---|
| Test equipment | Miele Softtronic W1935 WTL |
| Washing program | Cotton 20° C., 1 200 U/min |
| Dosage | 71.25 g test formulation[5)] + 3.75 g tested active compound |
| Washing cycles | 1 |
| Water hardness | 2.5 mmol/l $Ca^{2+}$:$Mg^{2+}$:$HCO_3^-$ 4:1:8 |
| Ballast fabric | 7 kg cotton towels<br>2 SBL 2004[4)] |

TABLE 9-continued

| Washing conditions: | |
|---|---|
| Soiled fabric | CFT-CS70[1)]<br>KC-H021[2)]<br>KC-H078[3)] |

[1)]CFT-CS 70, cotton fabric soiled with chocolate mousse, L* = 68.7 before wash
[2)]KC-H021, knitted cotton fabric soiled with lipstick, L* = 61.6 before wash
[3)]KC-H078, knitted cotton fabric soiled with lipstick, L* before wash 59.5 before wash
[1)2)3)]Producer: Center for Testmaterials BV, NL-3130 AC Vlaardingen
[4)]Producer: wfk Testgewebe GmbH, Christenfeld 10, D-41379 Brueggen
[5)]composition of test formulation: 5.5 g Linear alkyl benzene sulfonic acid, 2.4 g coconut fatty acid C12-18, 5.4 g C12-C14 alcohol + 2 mol EO + sulfated Na-salt (C12-C14 ethersulfate), 2.2 g KOH, 5.4 g C13-C15 Oxo alcohol + 7 mol EO, 6.0 g 1,2-propylene glycol, 2.0 g ethanol and water to 80 g.

The washing performance was determined by measuring the soiled fabric with the Multi Area Color-measurement Hardware, Mach 5, Testfabrics, Inc., Lab, for determining the ΔR(eflectance) calculated at 460 nm and ΔE calculated between unwashed and washed stain by Mach 5 software. The higher the value, the better is the performance. The results are outlined in Table 8 above. From the results, it can be gathered that the inventive compositions comprising two or more compounds of formula (I) show excellent degreasing capabilities for removing greasy and/or oil type deposits and/or food stains compared to compounds of the prior art.

Example 6

The degreasing properties of the composition comprising two or more compounds of formula (I) with regard to butter fat were demonstrated by using the launder-o-meter in comparison to compounds of the prior art.

The washing performance for the selected composition comprising two or more compounds of formula (I) in combination with a surfactant of the prior art was determined in the launder-o-meter as follows:

Several soil swatches were washed together with cotton ballast fabric and 20 steel balls at 25° C. in water in the launder-o-meter with the selected composition comprising two or more compounds of formula (I) together with the surfactant of the prior art or the comparative compound (surfactant of the prior art). The compositions comprising two or more compounds and the surfactant of the prior art used as well as the comparative compounds are outlined in table 10. After the washing, the fabrics were rinsed, spin-dried and dried in the air.

TABLE 10

Tested compounds and results for a washing time of 20 min

| | Fabric | ΔE | ΔΔE |
|---|---|---|---|
| Reference (formulation without tested compound) | CFT-CS 10 | 25.2 | — |
| 20.5 wt.-% C13-C15 Oxo alcohol + 7 mol EO[#1] (CE1)[#] | CFT-CS 10 | 26.0 | 0.8 |
| 10.5 wt.-% branched C13-Glucosid[#2] + 10 wt.-% C13-C15 Oxo alcohol + 7 mol EO[#1] (IE1)[#] | CFT-CS 10 | 26.4 | 1.2 |
| 10.5 wt.-% branched C13-Glycosid (66% Glucose/33% Xylose/1% Arabinose)[#3] + 10 wt.-% C13-C15 Oxo alcohol + 7 mol EO[#1] (IE2)[#] | CFT-CS 10 | 26.4 | 1.2 |

[#]amounts are based on the total weight of the test formulation
[#1]active content: 100 wt.-%, based on the total weight of the degreasing agent.
[#2]active content: 49.1 wt.-%, based on the total weight of the degreasing agent.
[#3]active content: 43 wt.-%, based on the total weight of the degreasing agent.

The washing conditions are outlined in table 11 below.

TABLE 11

| Washing conditions: | |
|---|---|
| Test equipment | Launder-o-meter, LP2 Typ, SDL Atlas Inc., USA |
| Washing liquor | 250 ml |
| Washing time/temperature | 20 min at 25° C. |
| Dosage | 1 g tested compound/L (79.5 wt.-% test formulation[2)] + 20.5 wt.-% tested compound) |
| Fabric/liquor ratio | 1:12.5 |
| Washing cycles | 1 |
| Water hardness | 2.5 mmol/l $Ca^{2+}$:$Mg^{2+}$:$HCO_3^-$ 4:1:8 |
| Ballast fabric | 15 g cotton fabric 283 |
| Sum ballast + soiled fabric | 20 g |
| Soiled fabric | 5 g CFT-CS 10[1)] |

[1)]CFT-CS 10, cotton fabric soiled with butter fat, L* = 90.7 before wash
[1)]Producer: Center for Testmaterials BV, NL-3130 AC Vlaardingen
[2)]composition of test formulation: 8.0 wt.-% monoethanol amine, 20.5 wt.-% linear alkyl benzene sulphonic acid, 10.5 wt.-% C12-C18-fatty acid mixture, 19.2 wt.-% 1,2-propanediol, 3.0 wt.-% ethoxylated polyethylene imine, 0.5 wt.-% diethylenetriamine penta (methylene phosphonic acid), 4.0 wt.-% glycerol, 0.1 wt.-% biocide and 13.7 wt.-% water. wt.-% is based on the total weight of the test formulation.

The washing performance was determined by measuring the soiled fabric with the Multi Area Color-measurement Hardware, Mach 5, Testfabrics, Inc., Lab, for determining the ΔR(eflectance) calculated at 460 nm and ΔE calculated between unwashed and washed stain by Mach 5 software. The higher the value, the better is the performance. The results are also outlined in Table 10 above. From the results, it can be gathered that the inventive compositions comprising two or more compounds of formula (I) show excellent degreasing properties for removing greasy and/or oil type deposits compared to compounds of the prior art.

Example 7

The degreasing properties of the composition comprising two or more compounds of formula (I) with regard to food stains such as Indian curry and soy sauce were demonstrated by using the washing machine in comparison to compounds of the prior art. The washing performance for the selected composition comprising two or more compounds of formula (I) in combination with a surfactant of the prior art was determined in the washing machine as follows: Several soil swatches were washed together with cotton ballast fabric (7 kg) and 2 soil ballast sheets wfk SBL 2004 in a Miele Household washing machine at cotton program 20° C. with the selected composition comprising two or more compounds of formula (I) in combination with a surfactant of the prior art or comparative compound (surfactant of the prior art). The compositions comprising two or more compounds in combination with the surfactant of the prior art used as well as the comparative compounds are outlined in table 12. After the washing, the fabrics were dried in the air.

TABLE 12

Tested compounds and results for a washing time of 20 min

| | Fabric | ΔE | ΔΔE |
|---|---|---|---|
| Reference (formulation without tested compound) | CFT-CS 59 | 14.7 | — |
| 20.5 wt.-% C13-C15 Oxo alcohol + 7 mol EO[#1] (CE1)[#] | CFT-CS 59 | 14.9 | 0.2 |

TABLE 12-continued

| Tested compounds and results for a washing time of 20 min | | | |
|---|---|---|---|
| | Fabric | ΔE | ΔΔE |
| 20.5 wt.-% branched C13-Glycosid (66% Glucose/33% Xylose/1% Arabinose)#2 (IE1)# | CFT-CS 59 | 15.8 | 1.1 |
| 10.5 wt.-% branched C13-Glycosid (66% Glucose/33% Xylose/1% Arabinose)#2 + 10 wt.-% C13-C15 Oxo alcohol + 7 mol EO#1 (IE2)# | CFT-CS 59 | 17.5 | 2.8 |
| 10.5 wt.-% branched C13-Glucosid#3 + 10 wt.-% C13-C15 Oxo alcohol + 7 mol EO#1 (IE3)# | CFT-CS 59 | 17.2 | 2.2 |
| Reference (formulation without tested compound) | CFT-CS 88 | 13.6 | — |
| 20.5 wt.-% C13-C15 Oxo alcohol + 7 mol EO#1 (CE2)# | CFT-CS 88 | 15.1 | 1.5 |
| 20.5 wt.-% branched C13-Glycosid (66% Glucose/33% Xylose/1% Arabinose)#2 (IE4)# | CFT-CS 88 | 18.6 | 5.0 |
| 10.5 wt.-% branched C13-Glycosid (66% Glucose/33% Xylose/1% Arabinose)#2 + 10 wt.-% C13-C15 Oxo alcohol + 7 mol EO#1 (IE5)# | CFT-CS 88 | 18.6 | 5.0 |
| 10.5 wt.-% branched C13-Glucosid#3 + 10 wt.-% C13-C15 Oxo alcohol + 7 mol EO#1 (IE6)# | CFT-CS 88 | 19.1 | 5.5 |

#amounts are based on the total weight of the test formulation

#1active content: 100 wt.-%, based on the total weight of the degreasing agent.

#2active content: 43 wt.-%, based on the total weight of the degreasing agent.

#3active content: 49.1 wt.-%, based on the total weight of the degreasing agent.

The washing conditions are outlined in table 13 below.

TABLE 13

| Washing conditions: | |
|---|---|
| Test equipment | Miele Softtronic W1935 WTL |
| Washing program | Cotton 20° C., 1 200 U/min |
| Dosage | 25 g (79.5 wt.-% test formulation4) + 20.5 wt.-% tested compound) |
| Washing cycles | 1 |
| Water hardness | 2.5 mmol/l $Ca^{2+}$:$Mg^{2+}$:$HCO_3^-$ 4:1:8 |
| Ballast fabric | 7 kg cotton towels<br>2 SBL 2004[3)] |
| Soiled fabric | CFT-CS 59[1)]<br>CFT-CS 88[2)] |

[1)]CFT-CS 59, cotton fabric soiled with soy sauce, L* = 92.4 before wash

[2)]CFT-CS 88, cotton fabric soiled with Indian curry, L* = 94.5 before wash

[1)2)]Producer: Center for Testmaterials BV, NL-3130 AC Vlaardingen

[3)]Producer: wfk Testgewebe GmbH, Christenfeld 10, D-41379 Brueggen

[4)]composition of test formulation: 8.0 wt.-% monoethanol amine, 20.5 wt.-% linear alkyl benzene sulphonic acid, 10.5 wt.-% C12-C18-fatty acid mixture, 19.2 wt.-% 1,2-propanediol, 3.0 wt.-% ethoxylated polyethylene imine, 0.5 wt.-% diethylenetriamine penta (methylene phosphonic acid), 4.0 wt.-% glycerol, 0.1 wt.-% biocide and 13.7 wt.-% water. wt.-% is based on the total weight of the test formulation The washing performance was determined by measuring the soiled fabric with the Multi Area Color-measurement Hardware, Mach 5, Testfabrics, Inc., Lab, for determining the ΔR(eflectance) calculated at 460 nm and ΔE calculated between unwashed and washed stain by Mach 5 software. The higher the value, the better is the performance. The results are outlined in Table 12 above. From the results, it can be gathered that the inventive compositions comprising two or more compounds of formula (I) show excellent degreasing capabilities for removing greasy and/or oil type deposits and/or food stains compared to compounds of the prior art.

The invention claimed is:

1. A composition comprising two or more compounds of the general formula (I),

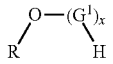

(I)

wherein R is unsubstituted branched $C_{13}$-alkyl and has an average number of branching in the range from 0.9 to 2.9, $G^1$ is selected from monosaccharides with 5 or 6 carbon atoms; x is in the range of from 1 to 1.8 and refers to average values, and wherein the two or more compounds differ in the average number of branching of R and/or $G^1$ and/or x.

2. The composition according to claim 1, wherein $G^1$ is selected from the group consisting of glucose, xylose, arabinose, rhamnose and mixtures thereof, and/or x is in the range of from 1.05 to 1.8.

3. The composition according to claim 1, wherein $G^1$ is selected from the group consisting of glucose, xylose, arabinose, rhamnose and mixtures thereof, and/or x is in the range of from 1.10 to 1.8.

4. The composition according to claim 1, wherein R is unsubstituted branched $C_{13}$-alkyl, and $G^1$ is glucose and/or xylose and x is in the range of from 1.05 to 1.8.

5. The composition according to claim 1, wherein R is unsubstituted branched $C_{13}$-alkyl and $G^1$ is xylose and x is in the range of from 1.10 to 1.8.

6. The composition according to claim 1, wherein R has an average number of branching in the range from 1.8 to 2.9.

7. The composition according to claim 1, wherein R has an average number of branching in the range from 2.0 to 2.5.

8. The composition according to claim 1, wherein the two or more compounds of the general formula (I) differ in the degree of branching of R.

9. A dry or liquid formulation comprising the composition as defined in claim 1.

10. The dry or liquid formulation according to claim 9, wherein the formulation further comprises additives selected from the group consisting of anionic surfactants, nonionic surfactants, cationic surfactants, amphoteric surfactants, enzymes, bleaching agents, peroxygen compounds, optical brightener, complexing agents, polymers, soaps, silicon based defoamers, colorants, dye transfer inhibitors and mixtures thereof.

11. The dry or liquid formulation according to claim 9, wherein the formulation is a single dose formulation or a high concentrated powder formulation having a bulk density of above 600 g/l.

12. A degreasing agent for removing greasy and/or oil type deposits which comprises the composition as claimed in claim 1.

13. The degreasing agent according to claim 12, wherein the degreasing agent is used to remove greasy and/or oil type deposits, at temperatures of <40° C.

14. An emulsifying agent which comprises the composition as claimed in claim 1.

15. A wetting agent comprising the composition as claimed in claim 1.

16. The wetting agent according to claim 15 wherein R is unsubstituted branched $C_{13}$-alkyl and $G^1$ is glucose and x is in the range from 1.05 to 1.8.

17. The wetting agent according to claim 15 wherein R is unsubstituted branched $C_{13}$-alkyl and $G^1$ is glucose and x is in the range from 1.10 to 1.8.

18. The wetting agent according to claim 15 as wetting agent at temperatures of ≥40° C.

19. The wetting agent according to claim 15 as wetting agent at a temperature in the range from 40 to 120° C.

20. The composition according to claim 8, wherein $G^1$ is selected from the group consisting of glucose, xylose, arabinose, rhamnose and mixtures thereof and x is in the range of from 1.10 to 1.8.

* * * * *